US007742004B2

(12) United States Patent
Fukushima et al.

(10) Patent No.: US 7,742,004 B2
(45) Date of Patent: Jun. 22, 2010

(54) ON-VEHICLE ANTENNA SYSTEM AND ELECTRONIC APPARATUS HAVING THE SAME

(75) Inventors: Susumu Fukushima, Osaka (JP); Akihiro Hoshiai, Osaka (JP)

(73) Assignee: Panasonic Corporation, Osaka (JP)

( * ) Notice: Subject to any disclaimer, the term of this patent is extended or adjusted under 35 U.S.C. 154(b) by 862 days.

(21) Appl. No.: 11/629,073

(22) PCT Filed: Apr. 3, 2006

(86) PCT No.: PCT/JP2006/307046

§ 371 (c)(1),
(2), (4) Date: Dec. 11, 2006

(87) PCT Pub. No.: WO2006/107018

PCT Pub. Date: Oct. 12, 2006

(65) Prior Publication Data

US 2008/0291097 A1 Nov. 27, 2008

(30) Foreign Application Priority Data

Apr. 4, 2005 (JP) ..... 2005-107250
Oct. 7, 2005 (JP) ..... 2005-294842

(51) Int. Cl.
*H01Q 1/32* (2006.01)

(52) U.S. Cl. ..... 343/713; 343/702; 343/792.5

(58) Field of Classification Search ..... 343/702, 343/713, 700 MS, 792.5
See application file for complete search history.

(56) References Cited

U.S. PATENT DOCUMENTS 4,701,764 A 10/1987 Malcombe
5,659,324 A 8/1997 Taniguchi et al.
6,008,767 A 12/1999 Taniguchi et al.
6,061,029 A 5/2000 Hisada
6,366,254 B1 * 4/2002 Sievenpiper et al. ..... 343/770
6,600,454 B1 7/2003 Moilanen
6,853,339 B2 * 2/2005 Sievenpiper et al. ..... 343/713
7,050,003 B2 * 5/2006 Sievenpiper ..... 343/700 MS
7,546,146 B2 * 6/2009 Sievenpiper et al. ..... 455/562.1

FOREIGN PATENT DOCUMENTS

JP 58-61509 4/1983
JP 61-222305 10/1986
JP 62-19083 4/1987
JP 63-126303 5/1988
JP 1-144702 6/1989

(Continued)

*Primary Examiner*—Tan Ho
(74) *Attorney, Agent, or Firm*—Wenderoth, Lind & Ponack, L.L.P.

(57) ABSTRACT

An on-vehicle antenna system which offers a superior receiving performance, by suppressing reception of reflected/scattered waves coming from inside of the vehicle's cabin; these reflected/scattered waves being an adverse factor which deteriorates signal receiving performance of an antenna. The antenna system is installed at glass pane portion of a vehicle with direction (12) of the greatest radiation pattern (11) directed towards ahead (14) of the vehicle from boundary plane (10) containing power supply portion (9), while direction (13) of the smallest radiation pattern (11) towards behind (15) of the vehicle. The above-configured antenna system can suppress those waves reflected/scattered in the vehicle cabin from being received; as the result, it demonstrates improved characteristics.

51 Claims, 21 Drawing Sheets

FOREIGN PATENT DOCUMENTS

| | | |
|---|---|---|
| JP | 3-63845 | 10/1991 |
| JP | 5-16681 | 3/1993 |
| JP | 5-91003 | 4/1993 |
| JP | 8-146117 | 6/1996 |
| JP | 8-298406 | 11/1996 |
| JP | 2648495 | 5/1997 |
| JP | 2980894 | 9/1999 |
| JP | 2000-36780 | 2/2000 |
| JP | 2001-211020 | 8/2001 |
| JP | 2002-135025 | 5/2002 |
| JP | 2002-538649 | 11/2002 |
| JP | 2003-163526 | 6/2003 |
| JP | 3458975 | 8/2003 |
| JP | 2004-88798 | 3/2004 |
| JP | 2004-242003 | 8/2004 |
| JP | 3594224 | 9/2004 |
| WO | 00/51203 | 8/2000 |

* cited by examiner

ON-VEHICLE ANTENNA SYSTEM AND ELECTRONIC APPARATUS HAVING THE SAME

TECHNICAL FIELD

The present invention relates to an on-vehicle antenna system for installation in vehicles, electronic apparatus such as radio receivers, television receivers, portable telephone systems, VICS (Vehicle Information and Communication System), etc. The invention relates also to an electronic apparatus mounted with the antenna system.

BACKGROUND ART

There are various types of antenna systems mounted on a vehicle nowadays. For example, radio receivers, television receivers, portable telephone systems, GPS (Global Positioning System), ETC (Electronic Toll Collection System), VICS, etc. have their own antenna systems that fit to their specific operation. Since vehicles are mobile substance, it is not easy for them to recognize direction of a certain signal where it is coming from, with these exceptions of GPS, ETC, etc. where recognition of the signal direction is comparatively easy. Based on the general understanding, radiation pattern of antenna for vehicles other than that for GPS, ETC, etc. has been designed to be non-directional with respect to horizontal direction of a vehicle.

Japanese Patent Unexamined Publication No. H8-298406 (hereinafter referred to as Document 1), Utility Model Unexamined Publication No. S58-61509 (Document 2) and Japanese Patent No. 3594224 (Document 3) are some of the known publications of prior arts on the on-vehicle antenna systems.

FIG. 22 shows a typical example of the on-vehicle antenna system disclosed in Document 1. Illustrated in FIG. 22 are first antenna wire 1001, second antenna wire 1002, power supply point 1003 provided for connection with the inner conductor of a coaxial cable which leads to a certain receiver unit, and rear window glass 1004 at the side of a vehicle. First antenna wire 1001 and second antenna wire 1002 are formed, respectively, into a rectangular shape, each having longer sides and shorter sides of its own. Between the longer sides of first antenna wire 1001 is a space D, and a space L between the shorter sides. There is a space K between the shorter side of first antenna wire 1001 and the shorter side of second antenna wire 1002. The antenna can be made to exhibit a non-directional characteristic by adjusting the spaces D, L and K.

Document 2 describes an on-vehicle antenna of space diversity antenna system. The antenna aims to make the directional characteristic into a substantially non-directional characteristic through a compensation of dip point of directional characteristic caused by the vehicle body, etc., using a plurality of antennas disposed at the vehicle's side window.

For the purpose of reducing the overall size of antenna system, monopole antennas of imbalanced operation have been employed for receiving television, radio broadcastings. Dipole antennas of balanced operation are not quite popular nowadays because they eventually take a large total size, and some other reasons. Monopole antenna element alone can not operate as an antenna, but it has to make use of metal body of the vehicle and the ground portion of coaxial cable's power supply line, etc. as part of the antenna system.

The antenna described in Document 1 is an imbalanced type antenna, which belongs to the same type as monopole antenna. It makes use of the metal body of vehicle and the ground portion of coaxial cable's power supply line as part of the antenna. Document 3 describes an imbalanced type antenna for use on a vehicle.

So far, on-vehicle antennas for radio, television reception have been designed so as they are non-directional; therefore, those of imbalanced type have been employed. However, as compared with an antenna installed above the roof of a vehicle, the above-described antenna installed at glass portion of vehicle demonstrates the significantly poorer reception characteristics.

FIG. 23 shows structure of a conventional dipole antenna. Distance between power supply section 1005 and base board 1006 is 15 mm, distance between first parallel side 1007 and second parallel side 1008 is 0.1 mm, length of first parallel side 1007 and second parallel side 1008 is 25 mm, length of first base side 1009 and second base side 1010 is 43.25 mm.

Those illustrated in FIG. 24 through FIG. 26 are used for describing the characteristics exhibited by a monopole antenna disposed at a vehicle's front windshield and a monopole antenna installed above the roof board for receiving digital surface wave television broadcasting.

FIG. 24 illustrates places where antenna was installed for receiving digital surface wave television broadcasting. Monopole antenna unit 2 was installed at three places of a sedan-type vehicle body. Installation point P1 is on the rear part of roof board 1, installation point P2 is at the lower area 23 of front windshield 3 on the cabin surface, installation point P3 is at the upper area 22 of front windshield 3 on the cabin surface. The receiving characteristics of the antenna at these three installation points were evaluated on.

FIG. 25 shows structure of monopole antenna unit 2. Monopole antenna unit 2 includes cylindrical antenna element 4 made of a conductive material, circuit board 5 which is mounted with circuit components such as a filter, an LNA (Low Noise Amplifier), etc., and coaxial cable 6 which connects with a tuner. Monopole antenna unit 2 does not operate with cylindrical antenna element 4 alone, but it functions as an antenna with collaboration of a ground plate provided on circuit board 5, a shield wire of power supply cable 6, and a vehicle frame made of conductive material.

FIG. 26 shows average reception power and percentage of reception in receiving a digital surface wave television broadcasting transmitted from a certain transmitting station, during a test conducted in a certain evaluation course which takes about 6 km a round. Shown in the chart is percentage of error-free receiving time, without a packet error, during one round cruising of the evaluation course. The result shown in FIG. 26 tells us that the reception percentage is the highest, although reception power is low in average, when monopole antenna unit 2 is installed above roof board 1, viz. installation point P1, as compared with the other setups where it is installed at the front windshield glass on the cabin surface, viz. installation points P2 and P3. Two other tests conducted in other district about several hundreds kilometers away from the above-mentioned evaluation course affirmed the earlier-demonstrated test result. The vehicle used in the tests is a sedan-type car installed with monopole antenna unit 2. A wagon-type car with the antenna unit also showed the same result. It was further recognized that even in a case where monopole antenna unit 2 was installed at a window glass other than front windshield, for example at a side window glass or rear windshield glass, the reception percentage was higher than the case where it was mounted above roof board 1.

Reasons why receiving characteristics deteriorate when monopole antenna unit 2 is installed at a window glass on the cabin surface, as compared with a case where it is disposed outside the cabin, had not been made sufficiently clear. The engineers involved in the present proposed technology started a thorough analysis of the causes by carrying out a number of experiments and simulations, and tried to find out a solution for improving the deterioration problem. They found out that the deterioration was caused in part by those reflected/scattered waves generated as the result of reflection/scattering of digital broadcasting waves by the vehicle's metal frame.

FIG. 27 shows a change along with the lapse of time with electric intensity of a 470 MHz-770 MHz plane wave incidental from outside of a vehicle and received by a monopole antenna installed on the vehicle's roof board.

FIG. 28 shows time-wise change in electric intensity of the wave received by a monopole antenna installed at upper area 22 of front windshield glass. Characteristics charts of FIG. 27 and FIG. 28 are those made available by a simulation analysis.

FIG. 29 is a time-wise waveform of electric intensity shown by a plane wave incoming from outside of a vehicle. The plane wave is arriving at the vehicle front with an angle of elevation 30 degrees.

As understood from FIG. 27, the electric intensity received by a monopole antenna installed above a vehicle's roof board shows a waveform pattern which is similar to that of incidental plane wave shown in FIG. 29. Waves reflected/scattered by a vehicle's metal frame are hardly observed received. On the other hand, the chart of electric intensity received by a monopole antenna disposed on upper area 22 of windshield shown in FIG. 28 indicates that the waves reflected/scattered by vehicle body, etc. are reaching the antenna with a delay of approximately 15 ns after arrival of direct wave 7. The approximate delay time 15 ns corresponds to a time which is needed by an electromagnetic wave to proceed for 4.5 m, or a time needed by an electromagnetic wave to go and return inside of the model vehicle cabin which was used in the present simulation analysis.

Judging from the results of experiments and simulations, a monopole antenna disposed at a vehicle's glass portion receives a number of those waves reflected/scattered by the vehicle's metal frame, etc.

The results of simulation analysis shown in FIG. 27 through FIG. 29 represent those situations where only one wave signal is arriving at a vehicle from the outside. In reality, however, a monopole antenna receives quite many signals at the same time, including those reflected/diffracted by buildings and other substances. Each of these signals is reflected/scattered by the vehicle's metal frame, and the monopole antenna receives also such reflected/scattered waves. These incoming waves change from time to time depending on changes in the environmental conditions for an electromagnetic wave, namely the change in location of reflecting substance (vehicles, human beings, trees, etc.). Furthermore, since these signals are received by a moving vehicle, the number and the incoming direction of arriving signals change remarkably from time to time. When an antenna receives a substantial number of such reflected/scattered waves that is changing moment after moment, it becomes difficult to conduct an equalization processing on propagation path at signal demodulation. Therefore, it makes it difficult to realize a high reception percentage, as shown in FIG. 26, despite the high average receiving power. The equalization processing of propagation path, which is a well-known technology among those in the industry, is for restoring a symbol's amplitude/phase information, which changes depending on a state of propagation path, to the original orientation based on information from a pilot signal.

Other deterioration factor with the reception percentage due to reflected/scattered waves in a vehicle cabin is that there is a difference in the Doppler frequency between a signal coming from the front or the behind of a vehicle received direct by on-vehicle antenna system and that received after it is reflected/scattered in the vehicle cabin. When a plurality of signals each having different Doppler frequency undergo a synchronized detection, symbol location of each demodulated signal is displaced along with the lapse of time from a should-be location, because of influence by the Doppler frequency. Especially in the digital television broadcasting which adopts OFDM (Orthogonal Frequency Division Multiplex) modulation, interference is caused at the synchronized detection between the carriers by the reflected/scattered waves in the cabin. Because of these, it turns out to be difficult to enforce the equalization processing on propagation path at a high accuracy level. This invites deterioration in bit error rate (BER) and packet error rate (PER), eventually causing deterioration of the antenna's receiving characteristics. The adverse influence of those waves reflected/scattered in a vehicle cabin reveals significantly when receiving the digital television broadcasting, digital radio broadcasting and portable telephone system which use digital signals. The influence ill-affects the demodulation also with the analog radio broadcasting and analog television broadcasting which use analog signals, and deteriorates the reception characteristics.

SUMMARY OF THE INVENTION

The engineers involved in the present proposed technology made extensive experiments and simulations, and understood the whole mechanism of deterioration how receiving of digital television broadcasting, etc. was ill-affected by those reflected/delayed waves caused by a metal frame of vehicle, etc. This subject had remained as a drawback whose picture was not clarified yet. Based on the new understandings, the engineers conceived that it was difficult to solve the deterioration issue through the conventional technical philosophy of pursuing an antenna of non-directional characteristics, or using a conventional monopole antenna aiming to reduce the overall size.

The present invention aims, on the basis of new knowledge, to overcome the inconvenience and offers an on-vehicle antenna system which would provide superior reception characteristics.

An on-vehicle antenna system in accordance with the present invention is installed at glass portion of a vehicle, with direction of the greatest radiation pattern directed towards ahead of the vehicle while the smallest radiation pattern towards behind of the vehicle. Or, it is installed at glass portion of a vehicle, with direction of the greatest radiation pattern directed towards outside of the vehicle's cabin in relation to the glass surface while the smallest radiation pattern towards inside of the cabin in relation to the glass surface. Being different from the conventional on-vehicle antenna systems which have non-directional radiation pattern, an on-vehicle antenna system in the present invention employs a certain directional antenna. The antenna system can receive only those waves arriving from outside of the vehicle, with those reflected/scattered waves suppressed. Receiving of the reflected/delayed waves, which being a key deteriorating factor with the antenna reception characteristics, is thus suppressed, and the reception characteristics are improved.

An on-vehicle antenna system proposed in the present invention is based also on the new inconveniences found out as the results of thorough studies carried out by the engineers involved, including the experiments and simulations for analyzing deterioration phenomenon due to those reflected/scattered waves caused by a metal frame of the vehicle. The engineers found out an effective means which significantly improves the reception characteristic of on-vehicle antenna system installed at a vehicle's glass portion by adopting an antenna having a certain directional property; the use of such a directional antenna was hardly thinkable in the conventional technical approach. A proposed antenna system provided at the glass portion of a vehicle, either on the surface at the vehicle's cabin or in the glass pane itself, in accordance with the present invention offers an additional advantage in favor of car designers who have long been afraid that an antenna installed outside of vehicle would injure subtle appearance of vehicle and induce a possible theft, besides an outstanding reception characteristic that is superior to conventional in-cabin antennas.

An electronic apparatus having on-vehicle antenna system, which being another item included in the present invention, is the one which is provided with at least one of a first on-vehicle antenna system installed at glass portion of the vehicle with direction of the smallest radiation pattern directed towards behind of the vehicle and a second on-vehicle antenna installed at glass portion of the vehicle with direction of the smallest radiation pattern directed towards inside of the cabin with respect to the glass surface.

REFERENCE MARKS IN THE DRAWINGS

1 Roof Board
2 Monopole Antenna Unit
3 Front Windshield Glass
9 Location of Power Supply Portion
10 Boundary Plane
11 Radiation Pattern
12 Direction of the Greatest Radiation Pattern
13 Direction of the Smallest Radiation Pattern
14 Direction towards Ahead
15 Direction towards Behind
16 Glass Surface Plane
17 Direction towards Outside of Cabin
18 Direction towards Inside of Cabin
19 Logarithmic Period Dipole Antenna
20, 29 Yagi Antenna
21 Array Antenna
22 Upper Area
23 Lower Area
24 Antenna Plate
25 Ground Plate
27 Dipole Antenna
28 Monopole Antenna
30 Pillar
31 Rear Glass

DETAILED DESCRIPTION OF PREFERRED EMBODIMENTS

First Exemplary Embodiment

An on-vehicle antenna system in accordance with a first embodiment of the present invention is described with reference to FIG. 1. In the following descriptions, the terminology "radiation pattern" means a radiation pattern of an on-vehicle antenna system itself, not a radiation pattern of that which is installed at glass portion of a vehicle and generated as the result of electromagnetic coupling with a metal frame of the vehicle. Namely, it does not mean a radiation pattern which contains an influence of metal frame.

Figure 1:
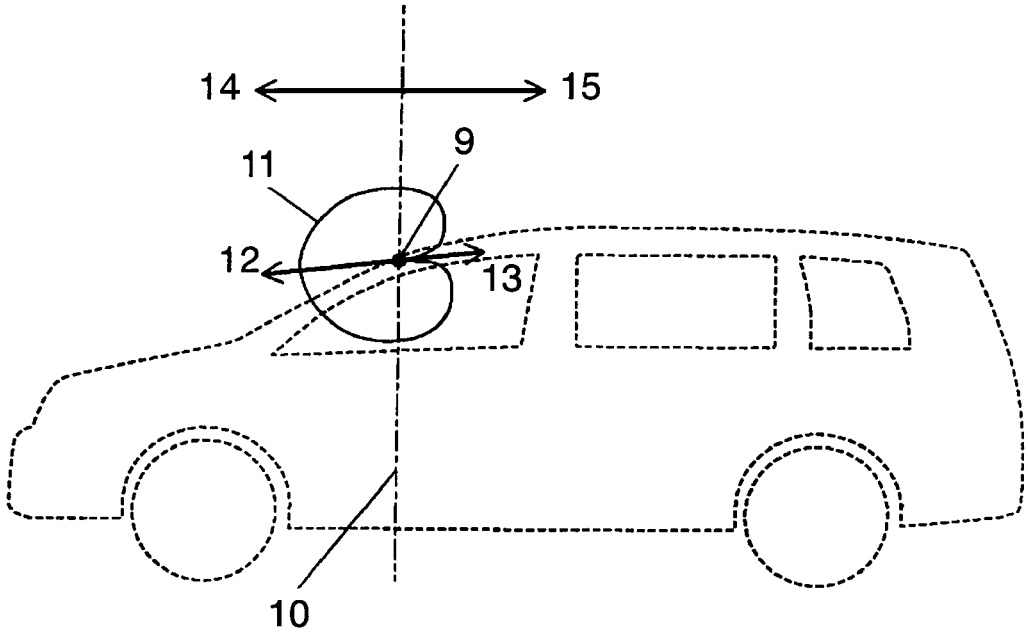
FIG. 1 Side view of an on-vehicle antenna system in accordance with a first exemplary embodiment of the present invention.

"Direction of the greatest radiation pattern" means, in an exemplary illustration FIG. 1, direction of the greatest gain 12 of radiation pattern 11 of the antenna system, as viewed from the location of power supply portion 9. "Direction of the smallest radiation pattern" means, in an exemplary illustration FIG. 1, direction of the smallest gain 13 of radiation pattern 11 of the antenna system, as viewed from the location of power supply portion 9.

"Direction towards ahead of a vehicle" means direction towards ahead of vehicle 14 from boundary plane 10 which contains the location of power supply portion 9 of radiation pattern 11. "Direction towards behind of a vehicle" means direction towards behind of vehicle 15 from boundary plane 10.

Based on the above definitions, that "direction of the greatest radiation pattern is directed towards ahead of a vehicle" means that direction of the greatest radiation pattern 12 of radiation pattern 11 is directed towards somewhere in the region ahead of vehicle 14 from boundary plane 10. That "direction of the smallest radiation pattern is directed towards behind of a vehicle" means that smallest radiation pattern 13 of radiation pattern 11 is directed towards somewhere in the region behind of vehicle 15 from boundary plane 10.

If an on-vehicle antenna system disposed at front windshield glass of the vehicle is provided with such directional pattern 11 directing towards ahead of the vehicle 14 as shown in FIG. 1, the antenna system can receive those direct signals arriving from ahead of the vehicle at a high gain. At the same time, it can suppress the level of receiving those reflected/scattered waves which have been reflected or scattered in the vehicle cabin. Those waves arriving from behind of the vehicle 15 are reflected and scattered by heater wire contained in the rear glass, metal frame of the vehicle body, seats in the cabin, etc. This means that the antenna system disposed at front windshield glass can not help receiving those waves arriving from the behind of vehicle 15 after they are reflected and/or scattered. So, if a superior receiving characteristic is to be provided, it is important not receiving those signals arriving from the behind of vehicle 15.

Since an on-vehicle antenna system in the present invention has a directional property whose radiation pattern 11 is directed towards ahead 14, the antenna system can avoid the above-described inconvenience. Thus a deterioration factor pertinent to an antenna system disposed at front windshield glass can be eliminated, and the antenna system would be able to generate superior reception characteristics.

In a case where an on-vehicle antenna system having a radiation pattern the greatest radiation pattern of which is directed towards behind of the vehicle while the smallest radiation pattern towards ahead is installed at rear windshield glass which contains a heater wire, an antenna for receiving television/radio broadcastings or something like that, it may be difficult for the antenna to exhibit the superior reception characteristics. This is because that the signals arriving from behind of the vehicle are reflected/scattered in the cabin and those reflected/scattered waves arriving from the front of the vehicle can be suppressed by the directional property of the antenna system, but those waves reflected/scattered by the heater wire, etc. disposed at the rear windshield glass may be difficult to suppress. Furthermore, since the heater wire and the antenna system make an electromagnetic coupling, it is may not be easy to realize a certain desired directional pattern. As the result, the antenna system receives the reflected/scattered waves more, as compared with a case where it is installed at front windshield glass. This means that the expected improvement of reception characteristics is difficult to realize. Therefore, an on-vehicle antenna system in the present invention may be installed at rear windshield glass only when the glass has no heater wire or the like conductive material.

Figure 2:
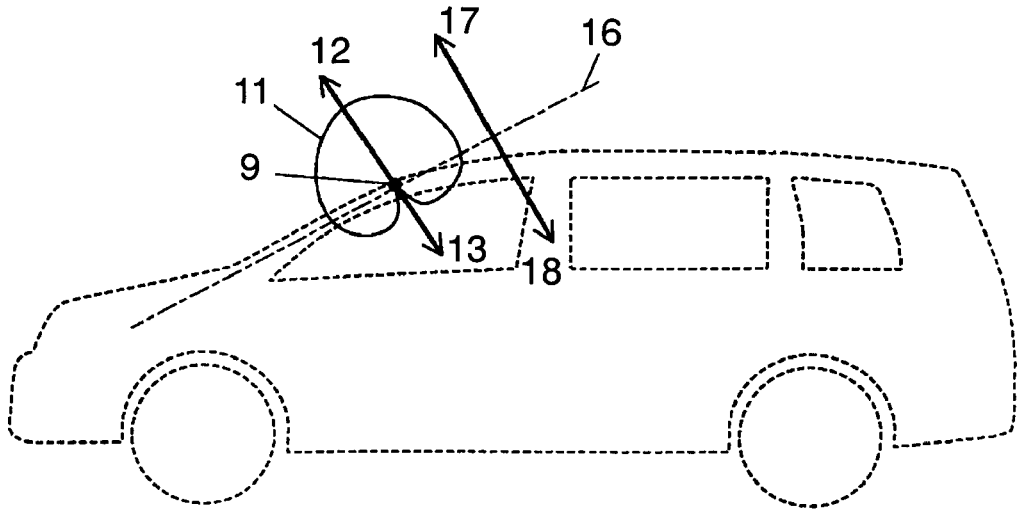
FIG. 2 Side view of other on-vehicle antenna system in the first embodiment.

Now, other example of on-vehicle antenna system in accordance with the first embodiment is described with reference to FIG. 2. FIG. 2 shows a radiation pattern demonstrated by other antenna system in the first embodiment installed at front windshield glass.

Location of power supply portion 9 of radiation pattern shown in FIG. 2 corresponds to an on-vehicle antenna system's location of power supply portion. In the forthcoming descriptions, "direction towards outside of cabin with respect to the glass plane" means, for example in FIG. 2, direction towards outside 17 of cabin with respect to glass plane 16. In the same manner, "direction towards inside of cabin with respect to the glass plane" means direction towards inside 18 of cabin with respect to glass plane 16.

By making radiation pattern 11 of an on-vehicle antenna system disposed at vehicle's glass portion to have a directional property towards outside 17 of vehicle cabin with respect to the glass plane as illustrated in FIG. 2, it can suppress level of receiving those waves reflected/scattered in the cabin. Thus, by the same reason as described in the earlier example of FIG. 1, an on-vehicle antenna system disposed at the vehicle's glass portion can demonstrate significantly improved receiving characteristics.

FIG. 2 illustrates an example where an antenna system is installed at the front windshield glass. However, the antenna system may be installed at the rear glass having no heater wire or the like conductive member, for generating the same advantage. Even in a case where there is a heater wire or the like conductive member in the rear glass, the antenna system may be installed there if you provide a microstrip antenna, a reverse F antenna or a reverse L antenna at the outside of the rear glass with its ground surface to be close to the glass. By so doing, the antenna system will generate the same advantage. The terminologies, reverse F antenna and reverse L antenna are well-known among people in the relevant field.

Figure 3:
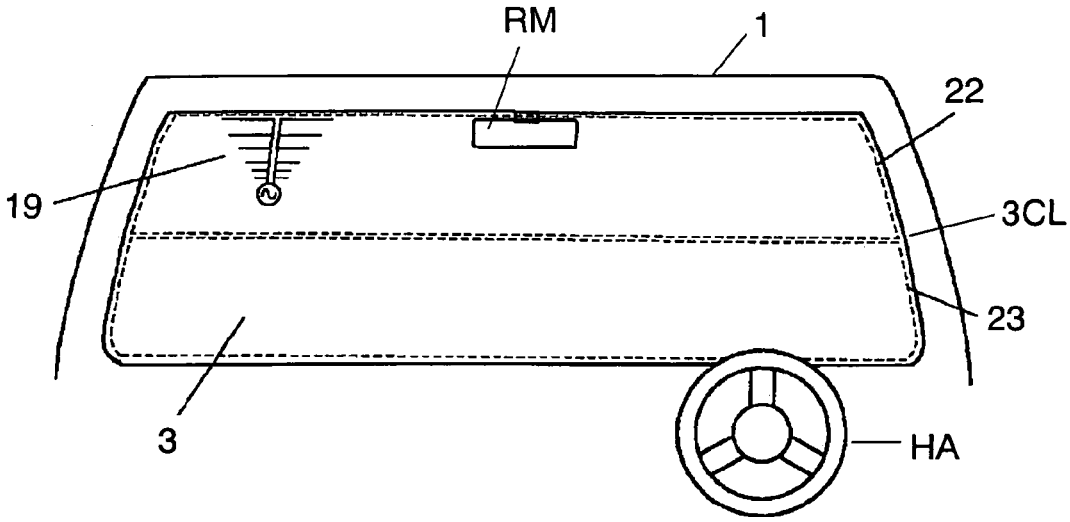
FIG. 3 Typified installed state of an on-vehicle antenna system in the first embodiment.
Figure 4:
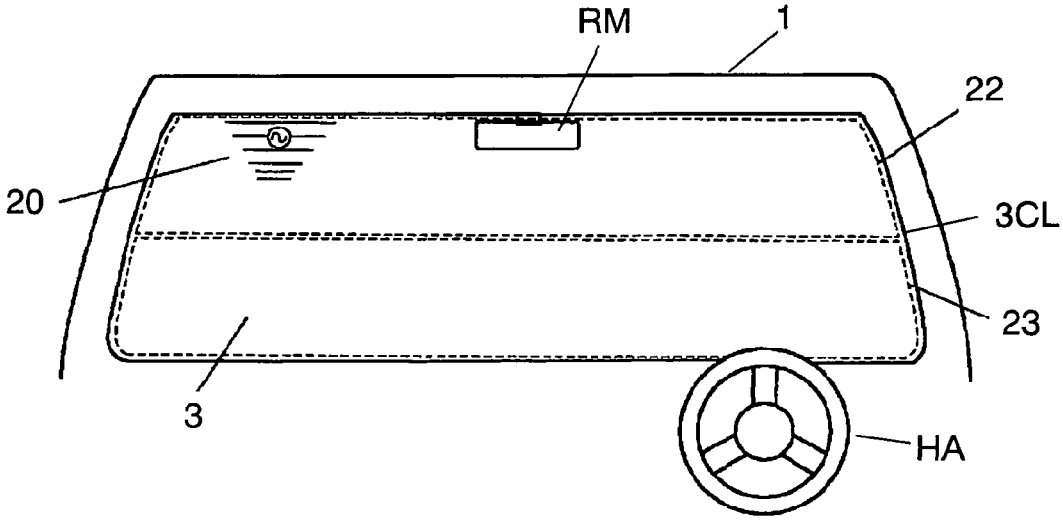
FIG. 4 Typified installed state of other on-vehicle antenna system in the first embodiment.
Figure 5:
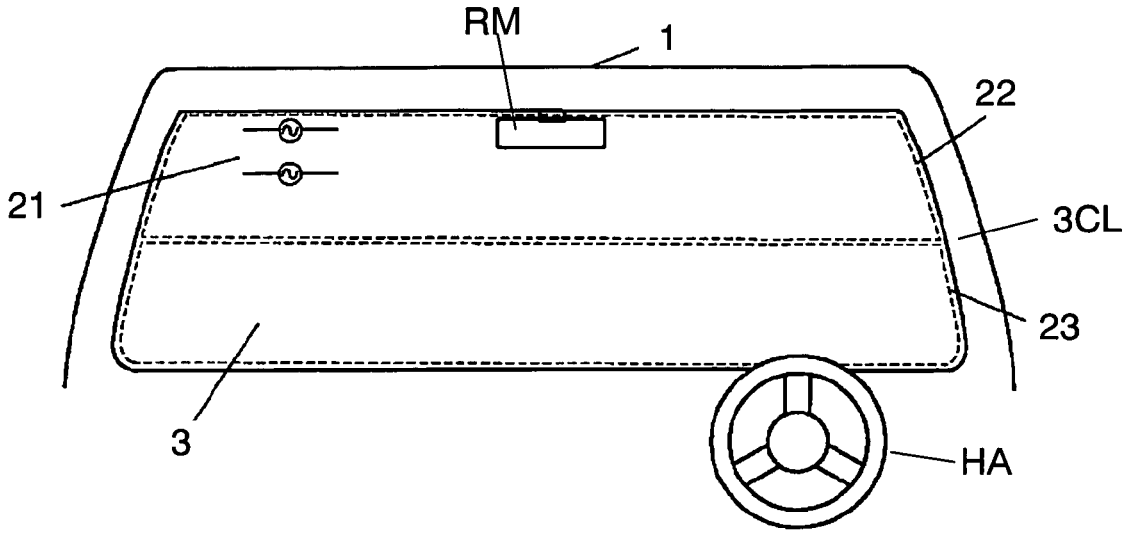
FIG. 5 Practical example of still other on-vehicle antenna system in the first embodiment.

FIG. 3 through FIG. 5 show typified state of on-vehicle antenna systems installed in accordance with the present invention, as viewed from within the cabin towards the front windshield glass.

Shown in FIG. 3 is logarithmic period dipole antenna 19 installed at upper area 22 of front windshield glass 3. The upper area means a region of front windshield glass 3 from the central portion 3CL up to the edge of roof board 1. Logarithmic period dipole antenna 19 can produce a certain directivity covering a broad band width. The antenna is installed in upper area 22 of front windshield glass 3, as shown in FIG. 3. Namely, the antenna installed with the power supply portion towards lower area 23 of front windshield glass 3 can provide a certain specific radiation pattern needed for an on-vehicle antenna system in the present invention.

Shown at upper area 22 of front windshield is a rear view mirror RM installed in the cabin, and a steering wheel HA at lower area 23.

Apart from the illustration FIG. 3, logarithmic period dipole antenna 19 may be installed instead in lower area 23 of front windshield glass 3, for example.

In FIG. 4, shown at upper area 22 of front windshield glass 3 is Yagi antenna 20. Yagi antenna 20 can realize a certain directivity which covers a broad band width with a simple power supply structure. Yagi antenna 20 is disposed with its director towards lower area 23 of front windshield 3 while its reflector to the up, as shown in FIG. 4. The antenna installed at upper area 22 of front windshield glass 3 can provide a certain radiation pattern needed for an on-vehicle antenna system in the present invention.

Apart from the illustration FIG. 4, Yagi antenna 20 may be disposed instead in lower area 23 of front windshield glass 3, for example.

Like in FIG. 3, a cabin rear view mirror RM is shown in upper area 22 of front windshield glass 3 and a steering wheel HA in lower area 23 in FIG. 4.

In FIG. 5, array antenna 21 is shown installed in upper area 22 of front windshield glass 3. Array antenna 21 is formed of, for example, two or more number of dipole antennas disposed in parallel. Array antenna 21 can realize a certain directional property in a relatively small size. Describing more practically, array antenna 21 is an end fire array antenna having its radiation beam directed in the axis direction of dipole antenna array. It is designed so that distance between the dipole antennas is $\lambda/4$, $\lambda$ being the wave length, and there is a 90 degree phase difference among the signals supplied to the dipole antennas. Namely, phase of a power supply to the dipole antenna locating closer to lower area 23 of front windshield glass 3 is lagging behind by 90 degrees from that supplied to the dipole antenna locating closer to roof board 1. Yagi antenna 20 installed at upper area 22 of front windshield glass 3 as shown in FIG. 5 can realize a certain desired radiation pattern.

Apart from the illustration FIG. 5, array antenna 21 may be installed instead in lower area 23 of front windshield glass 3, for example. By increasing the element counts of dipole antenna, it provides a radiation pattern having a still higher directional gain directed towards ahead of vehicle while a still lower directional gain directed towards behind of vehicle. This helps implementing a still better reception characteristic. In this case, however, it needs to be arranged as an end fire array antenna. Therefore, the distance between respective dipole antennas has to be $\lambda/4$, and the phase of power supply to adjacent dipole antennas has to be different by 90 degrees.

Like the examples shown in FIG. 3 and FIG. 4, a cabin rear view mirror RM is shown in upper area 22 of front windshield glass 3 and a steering wheel HA in lower area 23 in FIG. 5.

Those logarithmic period dipole antenna 19 in FIG. 3, Yagi antenna 20 in FIG. 4, and array antenna 21 in FIG. 5 are disposed at upper area 22 of front windshield glass 3. A rear view mirror RM in the cabin is also disposed at upper area 22. Instead of installing the antenna and the rear view mirror separately, the two items may be integrated into a single body, or the rear view mirror RM may be designed so that it can play the role of the antenna either.

Figure 6:
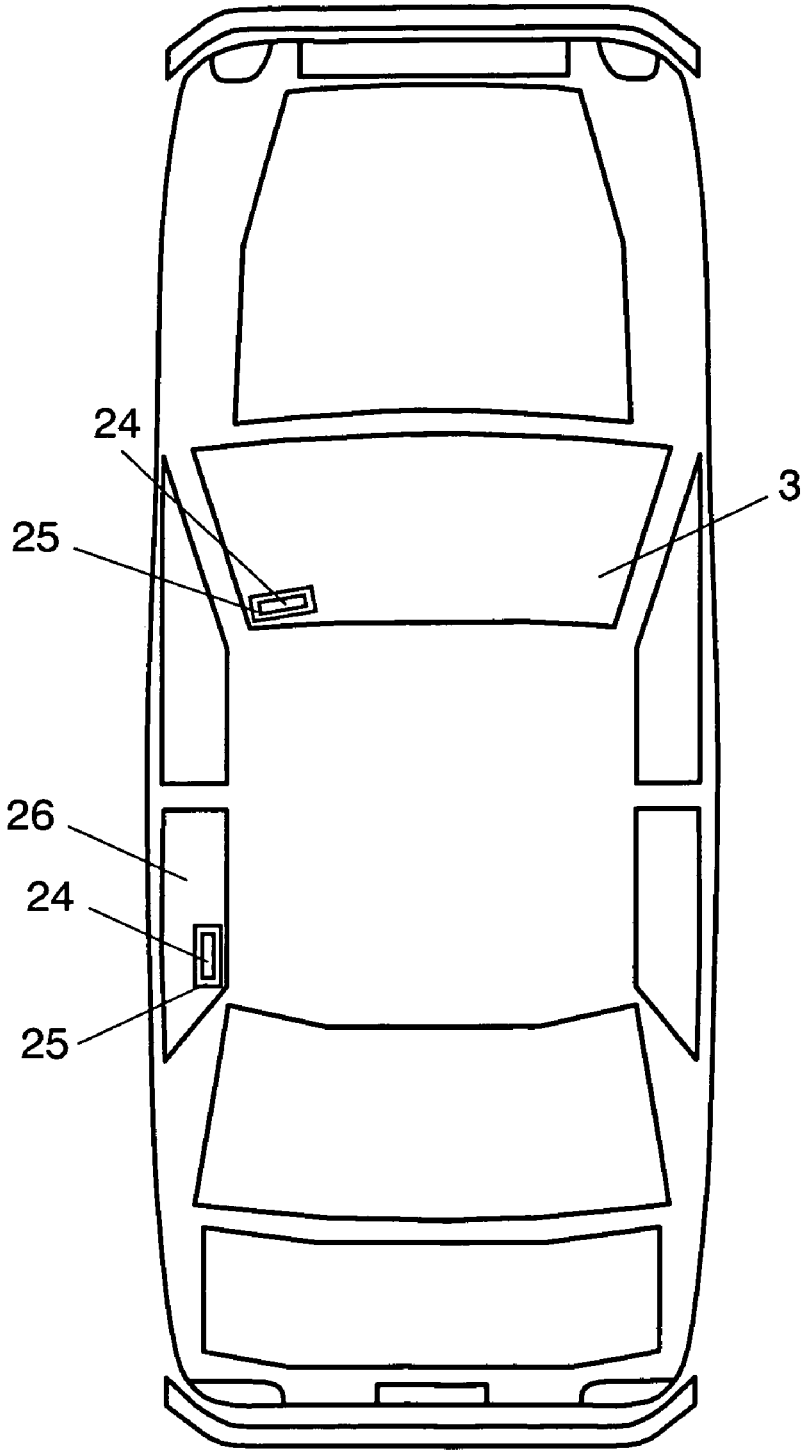
FIG. 6 Practical example of still other on-vehicle antenna system in the first embodiment.
Figure 7:
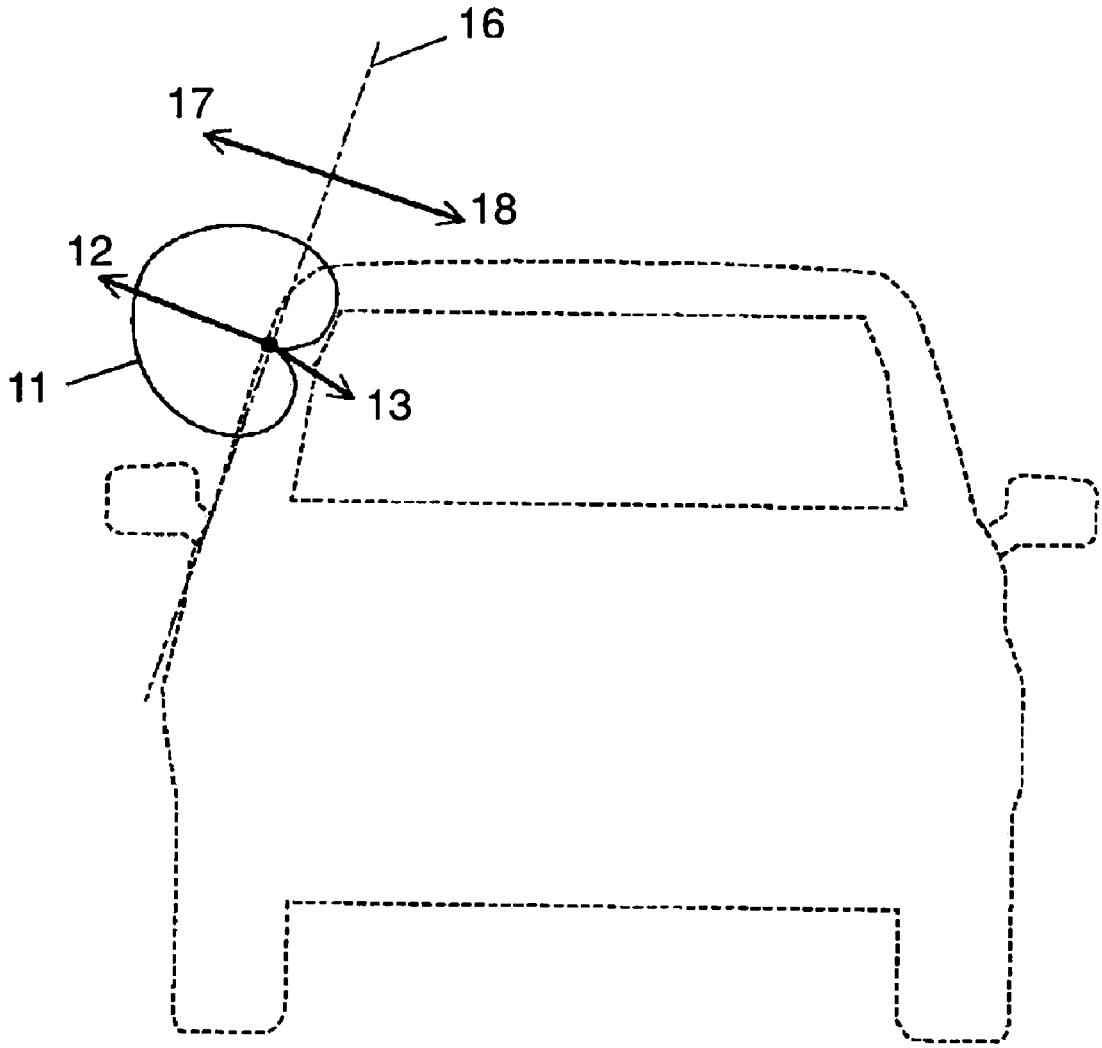
FIG. 7 Cross sectional view of an on-vehicle antenna system in the first embodiment, as viewed from behind.

FIG. 6 and FIG. 7 illustrate a practical example of on-vehicle antenna system in the present invention. FIG. 6 shows a vehicle as viewed from above; microstrip antenna is installed at front windshield glass 3 and rear side glass 26. The microstrip antenna is consisting of antenna plate 24 and ground plate 25 disposed opposed to each other. When a microstrip antenna is installed at the outside of vehicle cabin, it should be disposed so that its ground plate 25 makes contact with the glass surface; on the other hand, when the antenna is installed at the inside of the cabin, it is preferred that its antenna plate 24 is having contact with, or in proximity to, the glass surface. By so doing, a certain specific radiation pattern can be realized.

FIG. 6 shows a configuration where microstrip antenna is disposed at front windshield glass 3 and at rear side glass 26. It is also possible to form a diversity antenna with these two antennas. In this configuration, it can receive independently the signal arriving from ahead of the vehicle and that which is incoming sidewise. There can be no interference between the two antennas, but they can compensate to each other. So, the reception characteristics would be improved remarkably. Although a diversity antenna in FIG. 6 is formed by antenna disposed at front windshield glass 3 and that disposed at rear side glass 26, the diversity antenna may be formed instead by antenna disposed at the right side and the left side glasses, for generating the same effects. Furthermore, the space diversity effects can be generated also by disposing the antenna at the right area and the left area, or in the upper area and the lower area, of a front windshield. These configurations also bring about an improved reception characteristic. In place of the microstrip antenna described above, a Yagi antenna, a logarithmic period dipole antenna or an array antenna having two or more number of dipole antennas disposed in parallel may be installed at front windshield glass 3, and the same effects would be generated.

Furthermore, the number of antennas forming a diversity antenna is not limited to two, but three or more number of antennas may be used.

Although FIG. 6 illustrates an example which uses microstrip antenna, a reverse F antenna or a reverse L antenna may be used instead for the same effects.

Microstrip antenna may be installed at rear windshield glass if there is no heater wire or the like conductor existing at the rear glass; in a case where there is a heater wire or the like conductor in the glass, the antenna may be installed at the outside of cabin. Improved reception characteristics would be generated also in these cases, too.

FIG. 7 shows a practical radiation pattern demonstrated by microstrip antenna installed at rear side glass 26 as illustrated in FIG. 6. Direction 12 of the greatest radiation pattern 11 of the microstrip antenna is directed towards somewhere in a region outside of cabin 17 with respect to glass plane 16. Direction 13 of the smallest radiation pattern 11 is directed towards somewhere in a region inside of cabin 18 with respect to glass plane 16. Thereby, receiving of the reflected/scattered waves coming from inside of the cabin can be suppressed, and the reception characteristics are improved.

Figure 8:
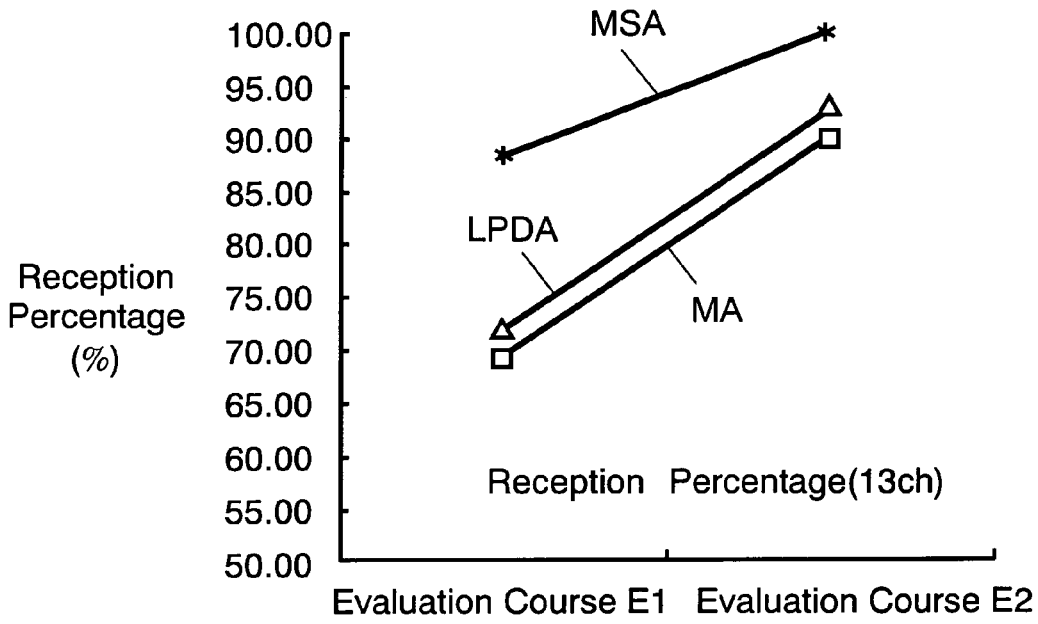
FIG. 8 Evaluation results of reception characteristics exhibited by an on-vehicle antenna system in the first embodiment.
Figure 9:
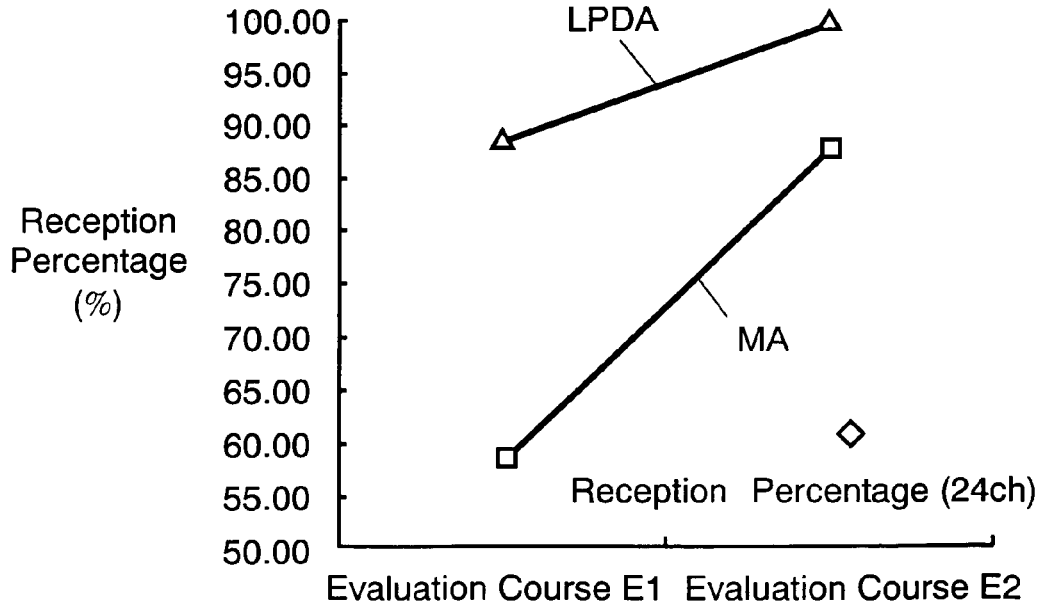
FIG. 9 Receiving characteristics evaluation results exhibited by an on-vehicle antenna system in the first embodiment.

FIG. 8 and FIG. 9 show results of evaluation on the receiving characteristics of antenna system in accordance with the present invention. Monopole antenna MA, logarithmic period dipole antenna LPDA and microstrip antenna MSA were installed at the upper area of front windshield glass of a sedan type vehicle, and the antennas tried to receive channel 13 and channel 24 of digital surface wave television broadcasting. FIG. 8 and FIG. 9 give percentage of successful receiving by respective antennas (percentage of error-free receptions during cruising of evaluation courses). Evaluation course E1 and evaluation course E2 are the public roads passing among 3-story, 4-story high buildings. There was no possibility for the antennas to receive signals direct from a transmitting station even on a clear passage lane of the evaluation courses. So, it can be said that the evaluation was conducted in an environment which is close to the Rayleigh fading wave environment.

From the reception percentages given in FIG. 8 and FIG. 9, it has been confirmed that, as compared with monopole antenna MA which was used for realizing a non-directional property, logarithmic period dipole antenna LPDA and microstrip antenna MSA being used for implementing an on-vehicle antenna system in accordance with the present invention are demonstrating superior reception percentages.

There had been a concern whether the reception characteristic significantly deteriorated to those signals coming from the direction of smallest radiation pattern, if an on-vehicle antenna system employed such a directional antenna. However, a wave environment in which the practical reception percentage is prone to deteriorate most is the Rayleigh fading environment, where there is no direct wave existing. In an ideal Rayleigh fading environment, signals are arriving from all the directions with equal probability. Therefore, it is hardly thinkable that signals arrive from the direction of smallest radiation pattern with a deviated probability density; but signals are considered to be arriving also from the direction of the greatest radiation pattern at a certain probability rate.

In the actual field tests, on-vehicle antenna system having a certain directional pattern demonstrated the higher reception percentage as compared with the monopole antenna having a non-directional pattern, as shown in FIG. 8 and FIG. 9. In a good test environment from which antennas can command unobstructed view of a transmitting station, not the Rayleigh fading environment, waves arrive direct and received by the antenna undisturbed; which means that the antennas are substantially in an area of strong electric field. So, a receiving error is difficult to occur in such an environment. In other actual receiving test conducted in the same manner as in FIG. 8 and FIG. 9 on an evaluation course which has an unobstructed view of a transmitting station, no deterioration was observed regarding the reception percentage.

Second Exemplary Embodiment

Figure 10:
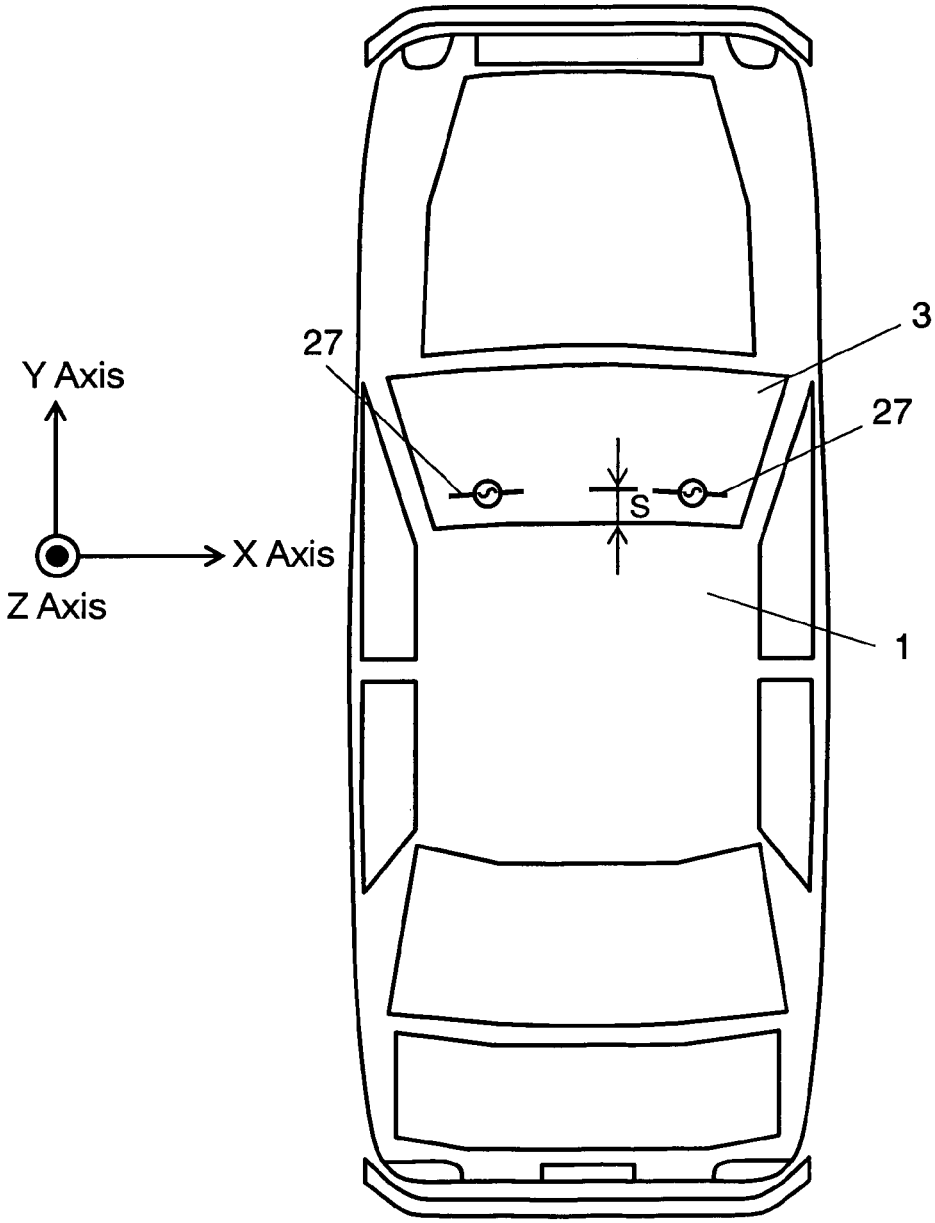
FIG. 10 An on-vehicle antenna system in accordance with a second exemplary embodiment of the present invention, as viewed from above.
Figure 11:
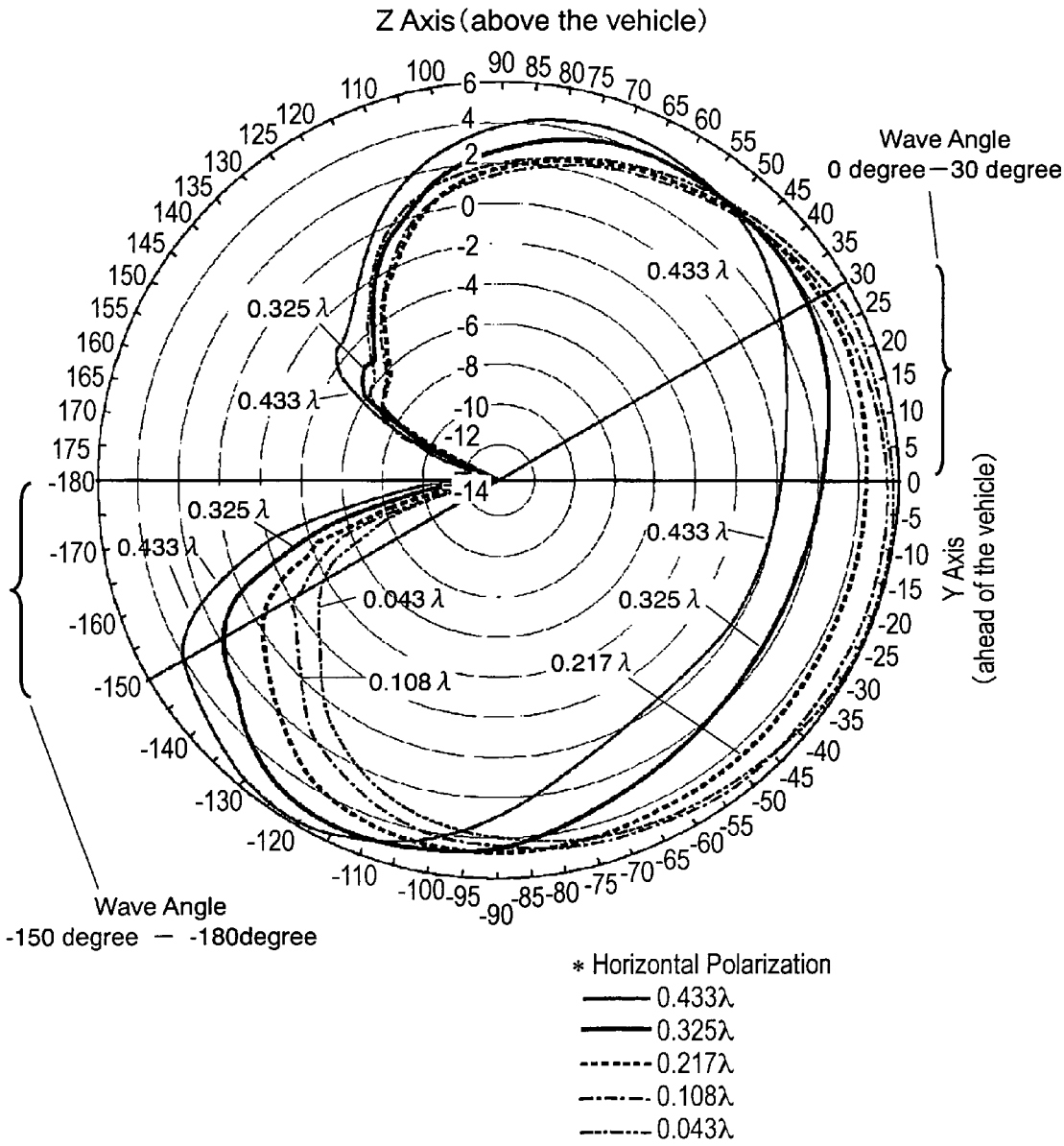
FIG. 11 Directional gain chart of an on-vehicle antenna system in the second embodiment.

An on-vehicle antenna system in accordance with a second embodiment of the present invention is described referring to FIG. 10 and FIG. 11.

FIG. 10 shows a vehicle viewed from above; dipole antenna 27 is installed at upper area of front windshield glass 3 away from roof board 1 by an antenna installation distance S. When dipole antenna 27 is disposed at the upper area of front windshield glass 3 as illustrated in FIG. 10, it makes an electromagnetic coupling with roof board 1 and the intrinsically non-directional radiation pattern changes to a certain directional radiation pattern. The radiation pattern (directional gain) is shown in FIG. 11. In FIG. 11, the directional gain (Y Z plane, horizontally polarized wave) of dipole antenna 27 disposed as illustrated in FIG. 10 is shown. The directional gain changes depending on the antenna installation distance S.

Taking notice on a direction of wave angle 0 degree-30 degrees, or the angle of high signal arriving probability, dipole antenna 27 may be disposed within a distance of 0.325λ from roof board 1. Then, roof board 1 works as reflector of dipole antenna 27 and the directional gain can be made to be 2 dBi or higher at the wave angle 0 degree-30 degree.

The angle incident upon dipole antenna 27 of those signals came into cabin from the direction of wave angle 0 degree-30 degree and reflected/scattered by metal substance, etc. in the cabin seems to be concentrating within a range between −150 degree and −180 degree, which being the opposite angle to the wave angle range 0 degree-30 degree. What is important in this occasion is that the directional gain at the angle range between −150 degree and −180 degree is small. If the antenna installation distance S between dipole antenna 27 and edge of roof board 1 is greater than 0.325λ, the directional gain at wave angle −150 degree becomes to be greater than that at wave angle 30 degree; namely, the antenna receives signals with more weight on the reflected/scattered waves which are coming from inside of the cabin.

Therefore, it is essential to install dipole antenna 27 within the antenna installation distance S 0.325λ (wave length) from the edge of roof board 1. Dipole antenna 27 installed at front windshield glass 3 in accordance with the above-described arrangement makes use of roof board 1 as the reflector and demonstrates superior receiving characteristics realizing a certain specific radiation pattern. The monopole antenna conventionally employed for an on-vehicle antenna system utilizes metal frame of the vehicle and the ground portion of a coaxial cable for power supply as part of the antenna. Therefore, the antenna is prone to receive the reflected/scattered waves.

Being different from the monopole antenna, since the dipole antenna performs a balanced operation it is not necessary for dipole antenna to utilize the vehicle's metal frame and the ground portion of power supply coaxial cable as part of the antenna. In this respect, the dipole antenna is not the type of antenna which readily receives the reflected/scattered waves coming from inside of the cabin. This is one of the important points for implementing a superior receiving performance. The same applies also to dipole-based Yagi antennas, logarithmic period dipole antennas and array antennas formed of two or more number of dipole antennas arranged on a straight line.

The method of using roof board 1 as the reflector and generating a higher directional gain in the direction towards ahead of a vehicle and a lower directional gain in the direction towards behind of the vehicle may be applied on Yagi antenna or logarithmic period dipole antenna, for reciting the same effects. If reflector of Yagi antenna is substituted by roof board 1, overall size of the antenna system can be further reduced.

The above-described dipole antenna, Yagi antenna, logarithmic period dipole antenna and array antenna may be provided formed within the glass pane. Or, the antennas may be provided by forming antenna conductor lines using a conductive material on a transparent film of PET (Polyethylene Terephthalate), PEN (Polyethylene Naphthalete), etc. and then affixing the film on the glass surface from inside. Method of forming the conductor lines can be a process of printing a conductor paste on the film, or depositing/sputtering copper or silver on a transparent film and etching it off leaving the area of antenna element. Or, copper or the like conductor lines may be affixed on a transparent film.

In order to provide seated passengers with a good visibility, it is preferred to install the antenna system at the upper area of front windshield glass, to be as close to the edge of roof board; describing more precisely, within 30 mm from the border between metal roof board edge and windshield glass, either contained in the glass pane itself or on the glass surface. When the antenna system is installed as such, the passengers can hardly recognize it, because it is almost hidden by decorative interior stuff disposed in the neighborhood region. This may also be another advantage.

In the cases of Yagi antennas, logarithmic period dipole antennas, array antennas, with which the overall size tends to become bulky, width of antenna elements may be made broader in a region hardly recognizable by the passengers' eyes, while that in other region narrower. By so doing, the radiation efficiency can be raised without substantially damaging the good sight.

The particulars of the second embodiment may be summarized as follows: Average width value of the antenna elements locating in a region within 30 mm from boundary between the metal roof board edge and windshield glass, regardless of either the elements are contained in the glass pane or on the surface of glass pane, is made to be greater than that of those locating out of the above region.

Third Exemplary Embodiment

Figure 12:
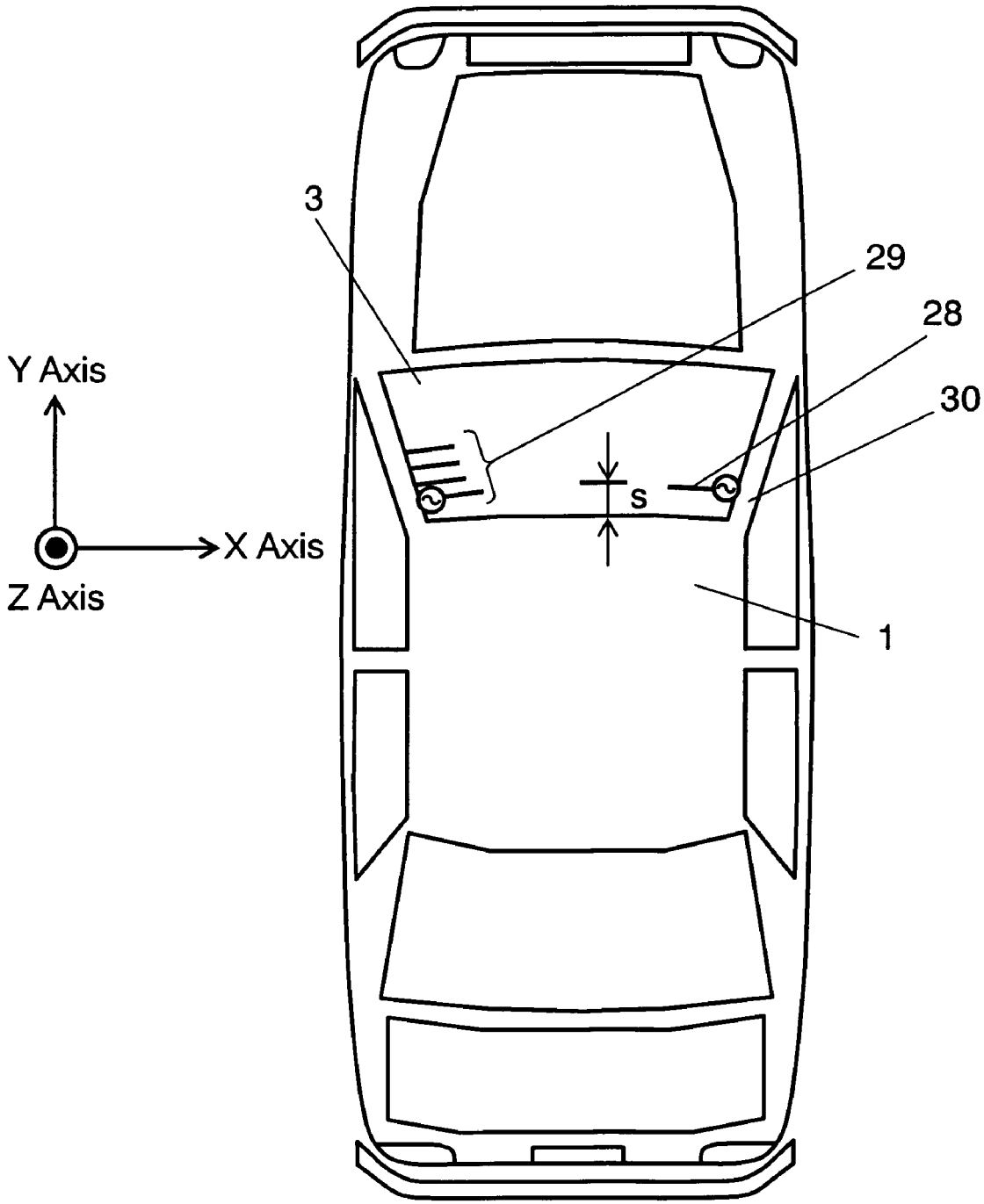
FIG. 12 An on-vehicle antenna system in accordance with a third exemplary embodiment of the present invention, as viewed from above.
Figure 13:
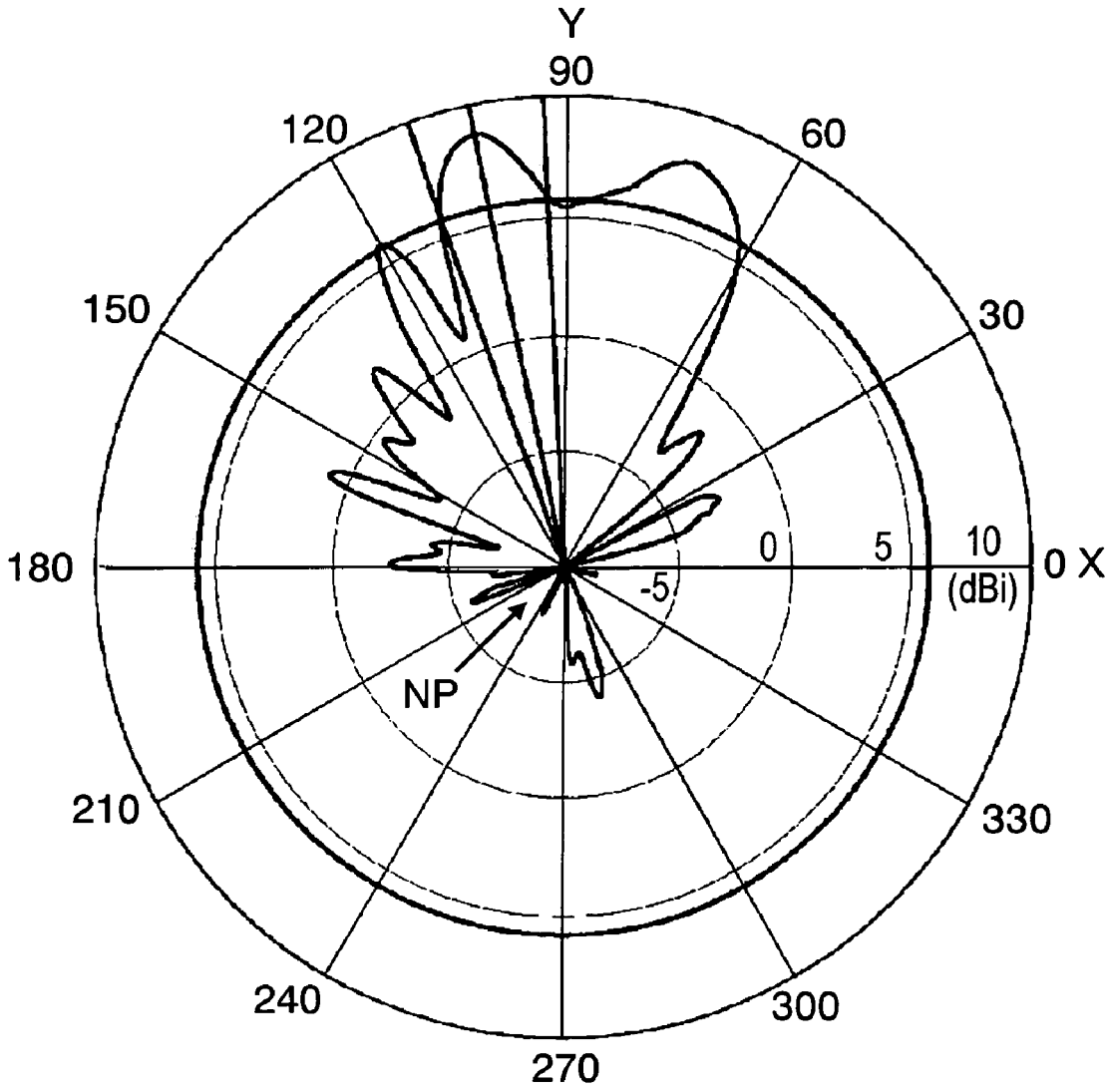
FIG. 13 Radiation pattern chart of a monopole antenna in the third embodiment.

FIG. 12 shows an on-vehicle antenna system in accordance with a third exemplary embodiment of the present invention, as viewed from above. In FIG. 12, monopole antenna 28 and monopole-structured Yagi antenna 29 are disposed at the upper area of front windshield glass 3 with an antenna installation distance S from roof board 1. Monopole antenna 28 and monopole-structured Yagi antenna 29 are disposed approximately perpendicular to pillar 30. In this setup, roof board 1 works as the reflector of monopole-structured Yagi antenna 29, which contributes to reduce the size of antenna system. When monopole antenna 28 is disposed at the upper area of front windshield glass 3 as shown in FIG. 12, it is electromagnetically coupled with roof board 1, and the radiation pattern, which intrinsically has a substantially non-directional pattern, changes into a certain directional pattern. FIG. 13 shows radiation pattern of monopole antenna 28 with X Y horizontally polarized wave. As understood also from FIG. 13, the radiation pattern of monopole antenna 28 demonstrates the greatest gain in the direction towards ahead of a vehicle. As compared with an on-vehicle antenna system shown in FIG. 10 employing a balanced-operation dipole antenna, the above-configured antenna system recites a remarkable advantage that the antenna size can be almost halved. In the cases of balanced-operation dipole antennas, Yagi antennas, array antennas and logarithmic period dipole antennas, a power supply line has to be disposed on the surface of front windshield glass, which ill-affects the good sight. When a monopole antenna is used, however, the power line can be disposed on the pillar, not on the surface of front windshield glass. Therefore, the good sight can be maintained.

Although FIG. 12 shows a monopole antenna and a monopole-structured Yagi antenna, the array antenna can be downsized likewise by employing a monopole antenna. Furthermore, the good sight for seating passengers can be maintained also with those antenna systems using monopole antenna 28, monopole-structured Yagi antenna and monopole-structured array antenna by disposing the antenna systems within the antenna installation distance S 30 mm. Still further, the radiation efficiency can be raised, while maintaining the good sight, also with those antenna systems using monopole antenna 28, monopole-structured Yagi antenna and monopole-structured array antenna by installing them within the antenna installation distance S 30 mm and making the width of antenna element broader.

Fourth Exemplary Embodiment

There is difference in the Doppler frequency between the signal, either coming from ahead of a vehicle or behind of a vehicle, received direct by an on-vehicle antenna system and that received after it was reflected/scattered in the vehicle cabin. This is one of the deterioration factors with respect to the receiving performance. Doppler frequency is produced because the vehicle is proceeding ahead, or behind; in other words, it is not produced with respect to the waves arriving from the direction perpendicular to the vehicle's moving direction. So, the generation of Doppler frequency may be suppressed by introducing an on-vehicle antenna system having a directional pattern, whose greatest radiation pattern is directed perpendicular to the vehicle's direction of proceeding forward-behind while the smallest radiation pattern towards ahead, or behind, of the vehicle.

After making a thorough study with focus on the generation of Doppler frequency, which being one of the deterioration factors, the engineers involved came to propose a concept which uses a diversity antenna, which would solve the problem under discussion.

Figure 14:
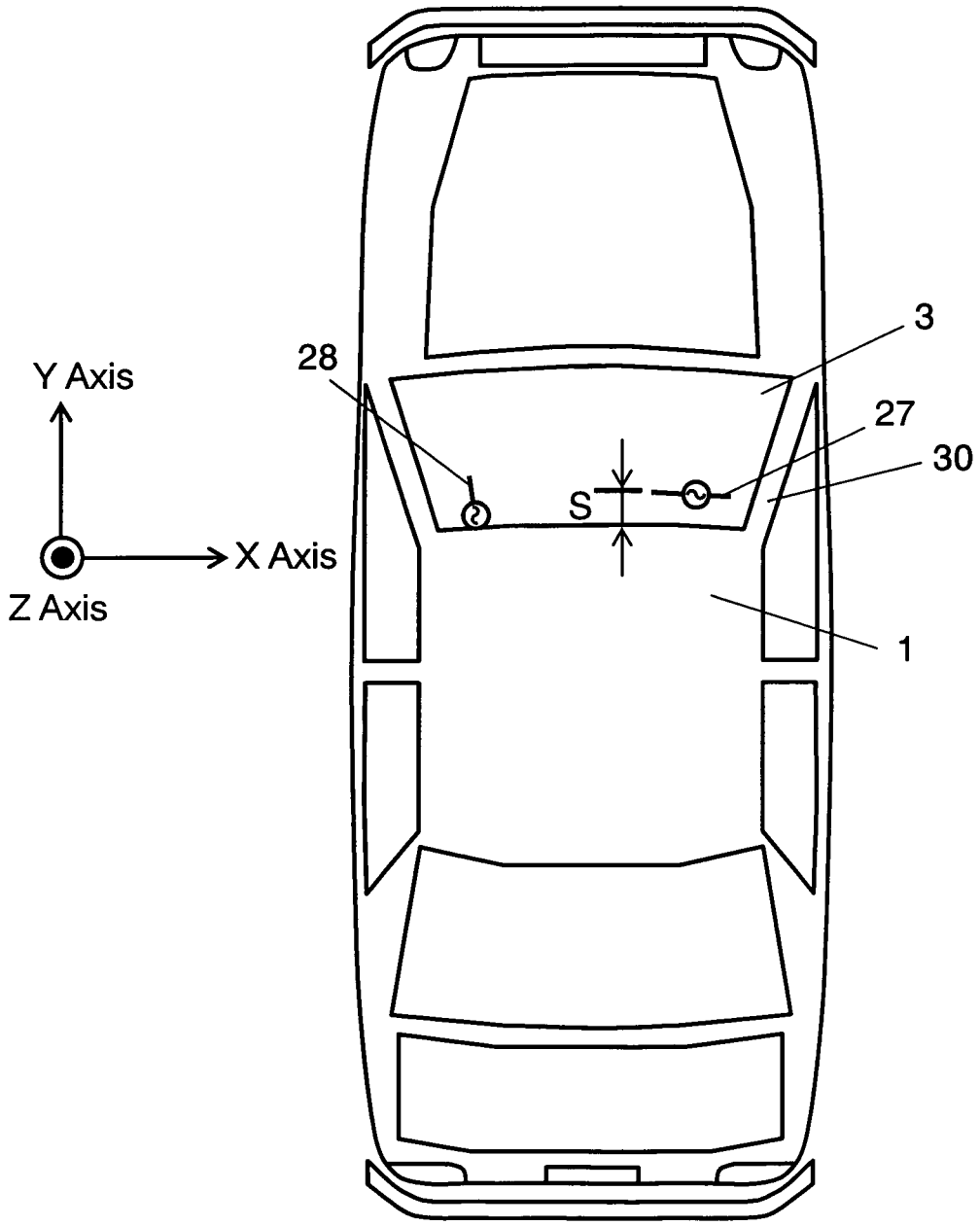
FIG. 14 An on-vehicle antenna system in accordance with a fourth exemplary embodiment of the present invention, as viewed from above.
Figure 15:
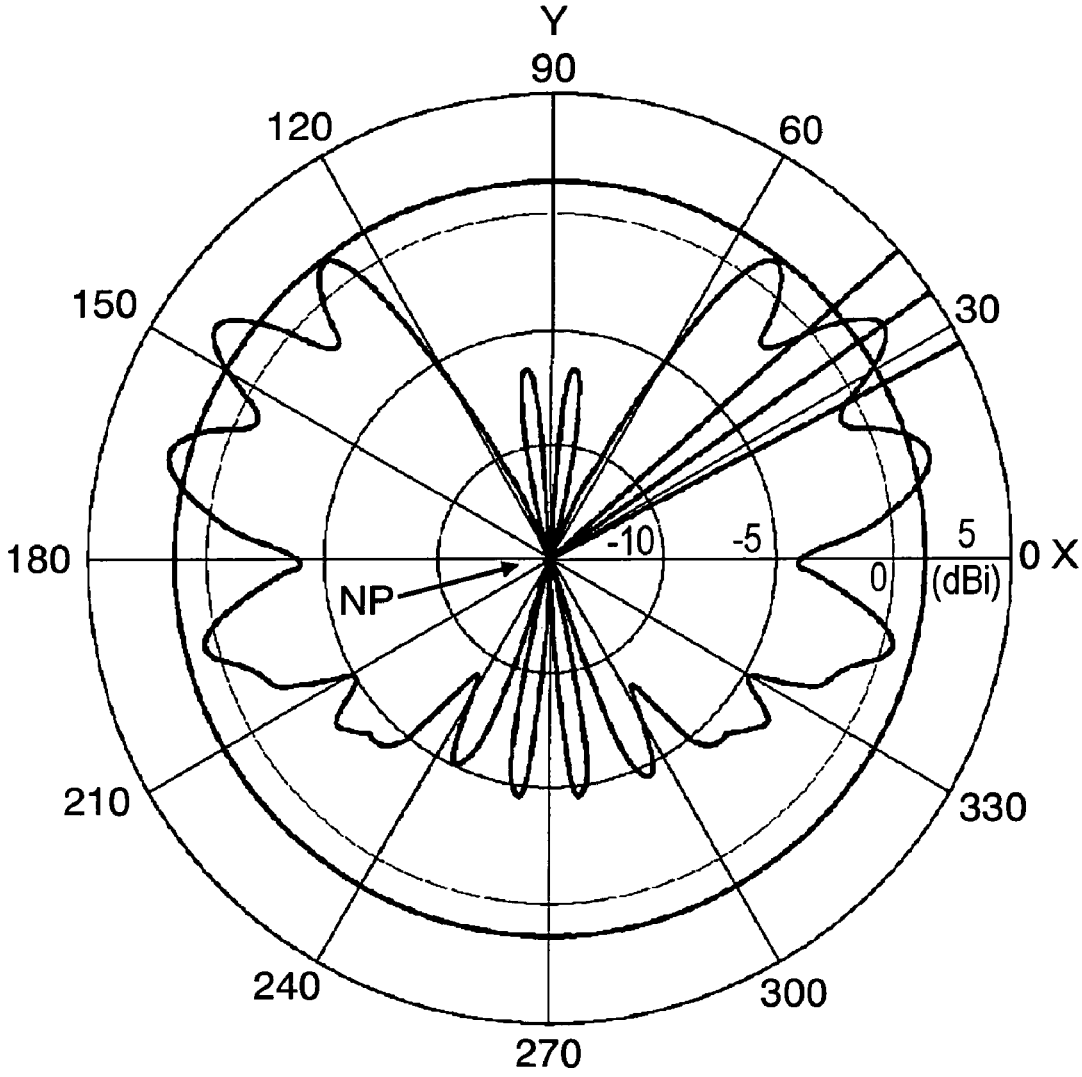
FIG. 15 Radiation pattern chart of a monopole antenna in the fourth embodiment.

An on-vehicle antenna system in accordance with a fourth embodiment of the present invention is described with reference to FIG. 14, a vehicle viewed from above. In the upper area of front windshield glass 3, dipole antenna 27 is disposed with the antenna installation distance S from roof board 1, and monopole antenna 28 is installed in the direction perpendicular to the border line between front windshield glass 3 and roof board 1. Monopole antenna 28 is disposed with the power supply portion at roof board 1. Since roof board 1 works as the reflector, dipole antenna 27 generates a radiation pattern having a certain directional property towards ahead of the vehicle as shown in FIG. 11. Monopole antenna 28 in FIG. 14 lets roof board 1 work as part of the antenna element and generates a radiation pattern as shown in FIG. 15, where the peak of radiation pattern is directing in line with X axis, or the direction penetrating both sides of the vehicle, while the null point (NP) in the forward—rear direction of the vehicle. Thus, dipole antenna 27 and monopole antenna 28 constitute a diversity antenna as illustrated in FIG. 14. The diversity antenna can suppress the generation of Doppler frequency, which being one of the deterioration factors, and demonstrates superior receiving performance in a compact and simple structure. Monopole antenna 28 may be disposed instead at rear windshield glass.

Figure 16:
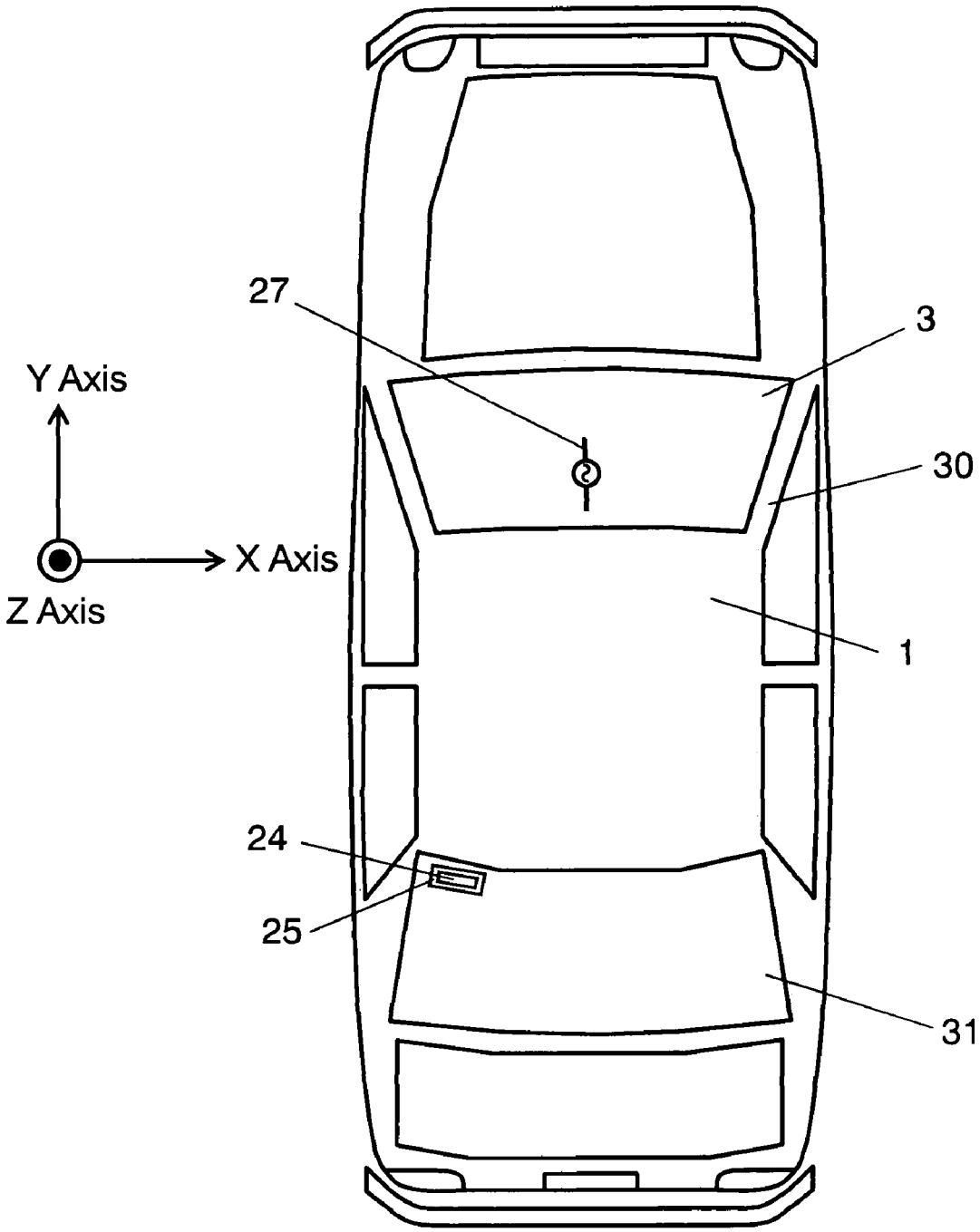
FIG. 16 Other on-vehicle antenna system in the fourth embodiment, as viewed from above.
Figure 22:
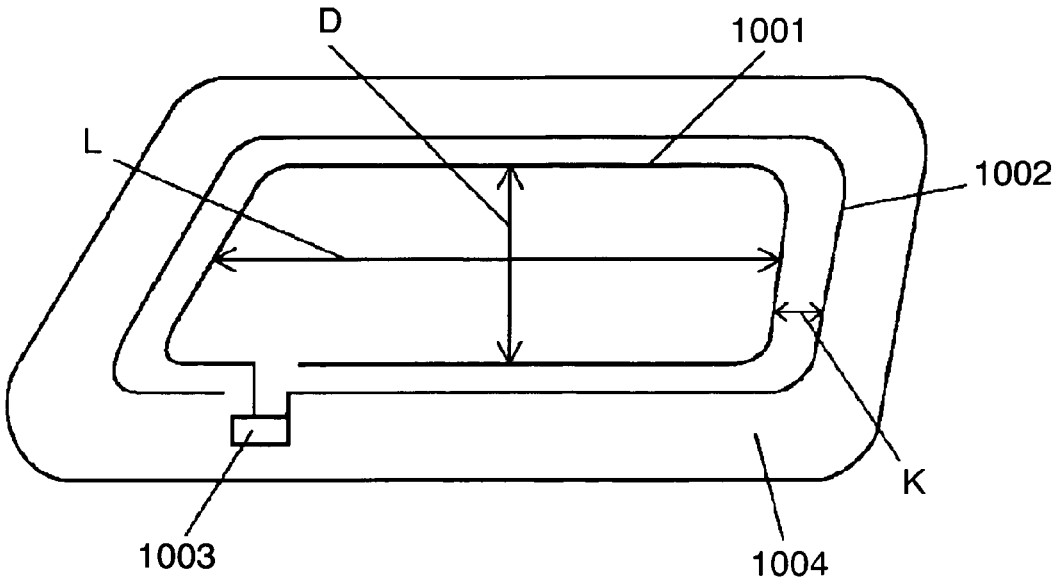
FIG. 22 Structure of a conventional on-vehicle antenna system, as viewed from above.

Other example of the fourth embodiment is described with reference to FIG. 16. A patch antenna formed of antenna plate 24 and ground plate 25 is affixed at rear windshield glass 31. At front windshield glass 3, dipole antenna 27 is disposed in the direction perpendicular to border of roof board 1 and front windshield glass 3. The dipole antenna in FIG. 16 has the greatest gain in the direction of X axis crossing both sides of a vehicle, while the null point (NP) in the front—rear direction of the vehicle. Patch antenna affixed at the rear windshield glass has a radiation pattern which is directed towards the behind alone. Thus, these two antennas constitute a diversity antenna that can suppress the generation of Doppler frequency, which being one of the deterioration factors. By disposing the antennas, respectively, at the front and the rear of a vehicle, inter-relationship between the antennas is alleviated and the radiation pattern improved. Furthermore, the ground surface of patch antenna lowers the radiation gain towards inside of cabin. Dipole antenna 27 shown in FIG. 16 may be disposed instead at the rear windshield glass for the same effects. Dipole antenna 27 shown in FIG. 16 may be replaced with monopole antenna 28 of FIG. 14. Still further, instead of the patch antenna shown in FIG. 22, dipole antenna 27 may be affixed at the front windshield glass as shown in FIG. 14 for reciting the same effects.

Fifth Exemplary Embodiment

Specific band of frequency used for the surface wave television broadcasting is as broad as 50% in UHF, 84% in VHF. It is not an easy task to realize such a broad specific band with a balanced type antenna. An on-vehicle antenna system in the fifth embodiment is the one which accomplished the task.

Figure 17:
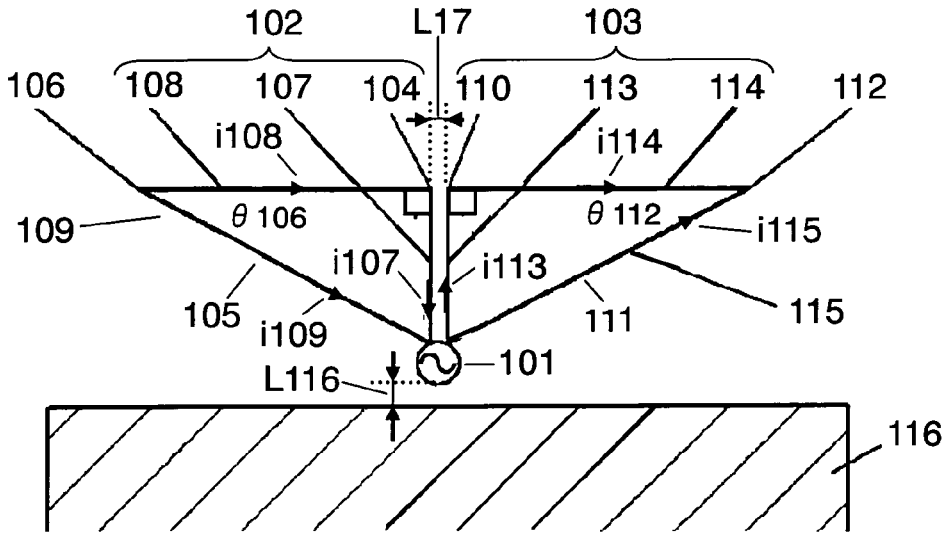
FIG. 17 Structure of an antenna system in accordance with a fifth exemplary embodiment of the present invention.

FIG. 17 shows the structure of an antenna system in accordance with the fifth embodiment. The antenna system is a balanced type antenna which includes power supply section 101, first conductor 102 of an approximate right-angled triangle link connected with power supply section 101, and second conductor 103 which is line symmetrical to first conductor 102 with respect to a straight line containing power supply section 101.

First conductor 102 has first right-angled vertex 104, first power supply vertex 105 connected with power supply section 101, and first acute angle vertex 106 other than those first right-angled vertex 104 and first power supply vertex 105. First conductor 102 includes first parallel side 107 connecting first power supply vertex 105 and first right-angled vertex 104 straight, first triangle base 108 connecting first right-angled vertex 104 and first acute angle vertex 106 straight, and first oblique side 109 connecting first acute angle vertex 106 and first power supply vertex 105 straight.

Second conductor 103 has second right-angled vertex 110, second power supply vertex 111 connected with power supply section 101, and second acute angle vertex 112 other than those second right-angled vertex 110 and second power supply vertex 111. Second conductor 103 includes second parallel side 113 connecting second power supply vertex 111 and second right-angled vertex 110 straight, second triangle base 114 connecting second right-angled vertex 110 and second acute angle vertex 112 straight, and second oblique side 115 connecting second acute angle vertex 112 and second power supply vertex 111 straight. First conductor 102's first parallel side 107 and second conductor 103's second parallel side 113 are disposed substantially parallel to each other.

The antenna system is disposed so as, for example, first triangle base 108 and second triangle base 114 are substantially parallel to conductive base 116. Further, the antenna system is disposed so as power supply section 101 is closest to base 116. The antenna system is disposed, for example, at front windshield glass so that first triangle base 108 and second triangle base 114 are substantially parallel to the boundary line formed between base 116, or the roof board of vehicle, and the front windshield glass.

Now, in the following, the operation how an antenna system in the fifth embodiment receives signal is described referring to FIG. 17.

First conductor 102 is supplied from power supply section 101, and reception current i 108 which contributes to the signal reception flows in first oblique side 109, first parallel side 107 and first triangle base 108, respectively. Likewise, second conductor 103 is supplied from power supply section 101, and reception current i 114 which contributes to the signal reception flows in second oblique side 115, second parallel side 113 and second triangle base 114, respectively.

Reception current i 109 in first oblique side 109 flows from first acute angle vertex 106 towards first power supply vertex 105. Reception current i 115 in second oblique side 115 flows from second power supply vertex 111 towards second acute angle vertex 112. The antenna system resonates at a certain specific resonance frequency f1 because of reception currents i 109 and i 115 in first oblique side 109 and second oblique side 115. On the other hand, reception current i 108 in first triangle base 108 flows from first acute angle vertex 106 towards first right-angled vertex 104. Reception current i 114 in second triangle base 114 flows from second right-angled vertex 110 towards second acute angle vertex 112. The antenna system resonates at a certain specific resonance frequency f2 because of reception currents i 108 and i 114 in first triangle base 108 and second triangle base 114.

The flow direction of reception current i 107 in first parallel side 107 and that of reception current i 113 in second parallel side 113 is opposite to each other, as shown in FIG. 17. Thereby, reception current i 107 in first parallel side 107 and reception current 113 in second parallel side 113 set off to each other, so first parallel side 107 and second parallel side 113 play the role of a transmission line.

Specific band of an antenna system becomes broader because of these two different resonance frequencies f1 and f2 in the antenna system. As already described earlier, specific band is the measure for a frequency range, within which range a certain antenna characteristic is maintained with respect to the center frequency.

In the fifth embodiment, specific band is obtained from a calculation, based on antenna impedance specified by resonance frequency of antenna, of frequency range which makes the antenna VSWR (Voltage Standing Wave Ratio) characteristic 3 or lower. VSWR is an index for showing how much of the energy inputted to an antenna is transmitted and radiated without being reflected due to mismatching of antenna and propagation path. As expediency, the specific band in the fifth embodiment has been calculated assuming that the VSWR characteristic is greater than 3.

Since it is disposed so that first power supply vertex 105 and second power supply vertex 111 have an acute angle, both of first oblique side 109 and second oblique side 115, which are contributing to the radiation, can be separated from base 116 for a certain distance. As the result, an undesirable coupling between first oblique side 109, second oblique side 115 and base 116 can be avoided, and the radiation characteristics of antenna system improved. Although the operation of antenna system has been described at its signal reception, the same description applies to its signal transmitting operation. Specific band of the above antenna system changes depending on an angle of first acute angle vertex 106 and second acute angle vertex 112.

Figure 18:
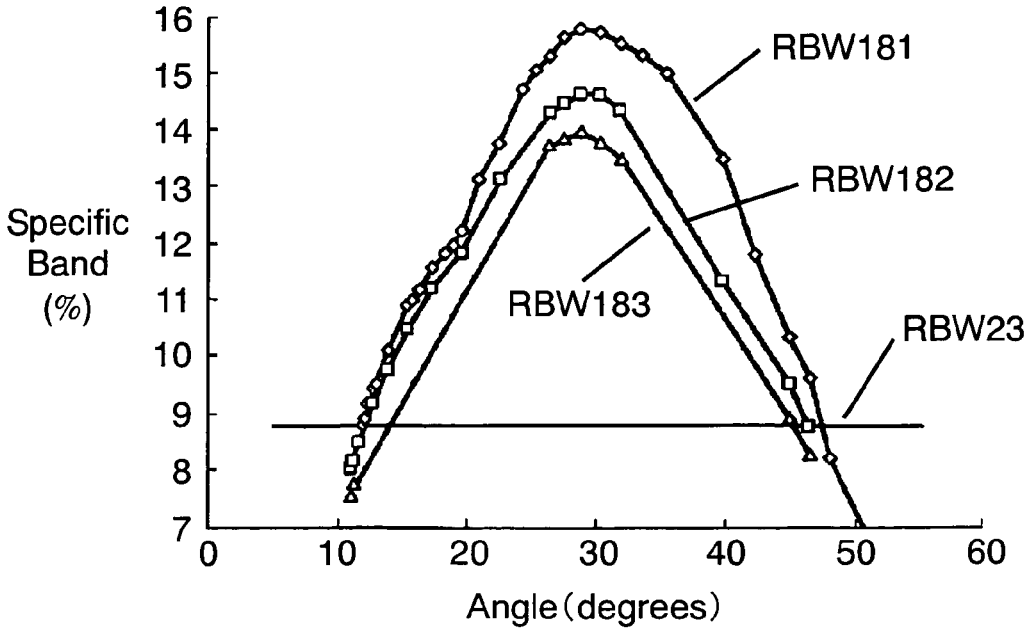
FIG. 18 Chart of relationship between the angle at first/second acute angle vertex and the specific band in an antenna system in the fifth embodiment.
Figure 23:
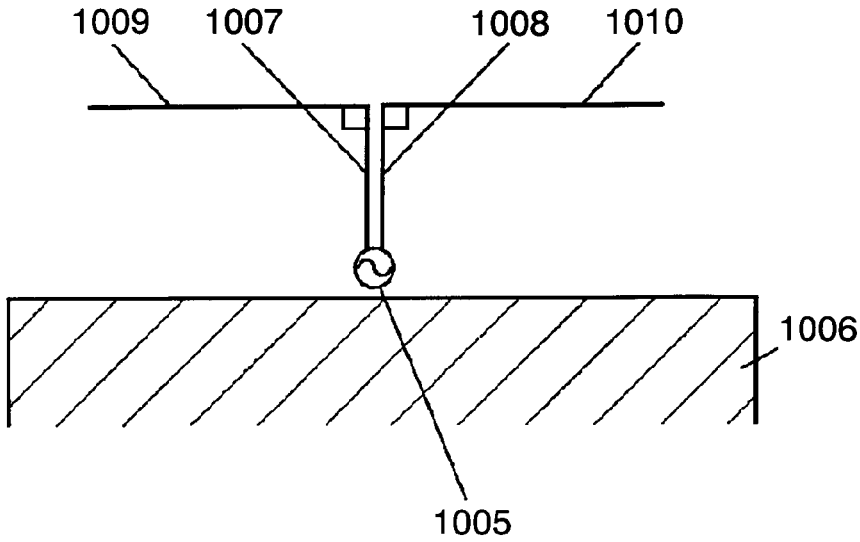
FIG. 23 Structure of a conventional dipole antenna.
Figure 24:
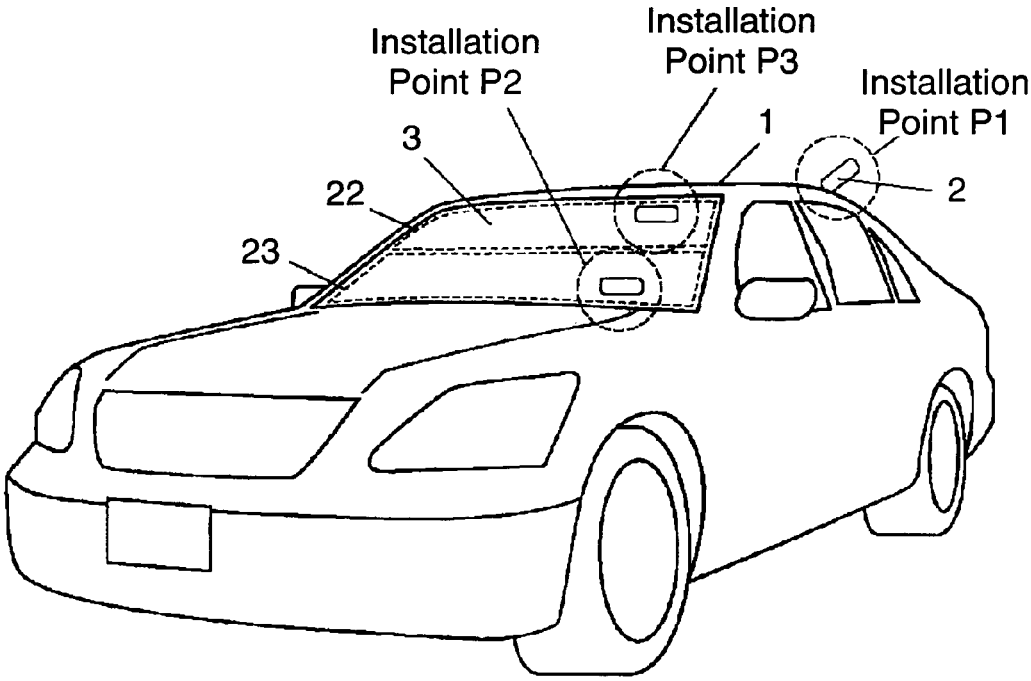
FIG. 24 Perspective view showing conventional antenna installation points.
Figure 25:
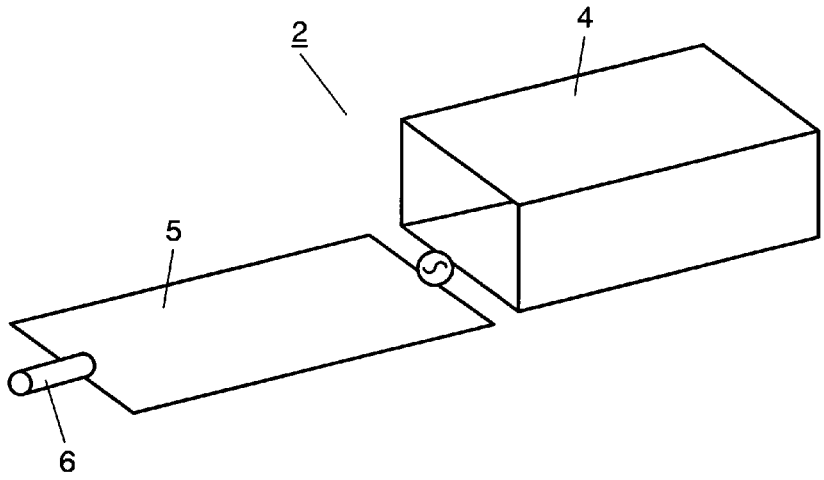
FIG. 25 Perspective view of a conventional monopole antenna.
Figure 26:
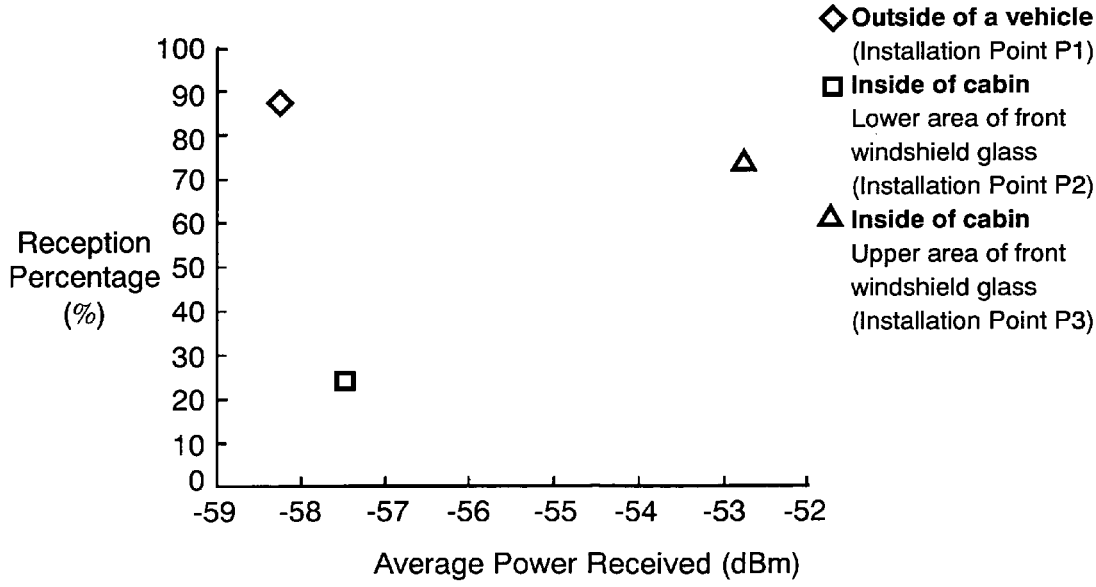
FIG. 26 Receiving characteristics evaluation results exhibited by a conventional antenna system.
Figure 27:
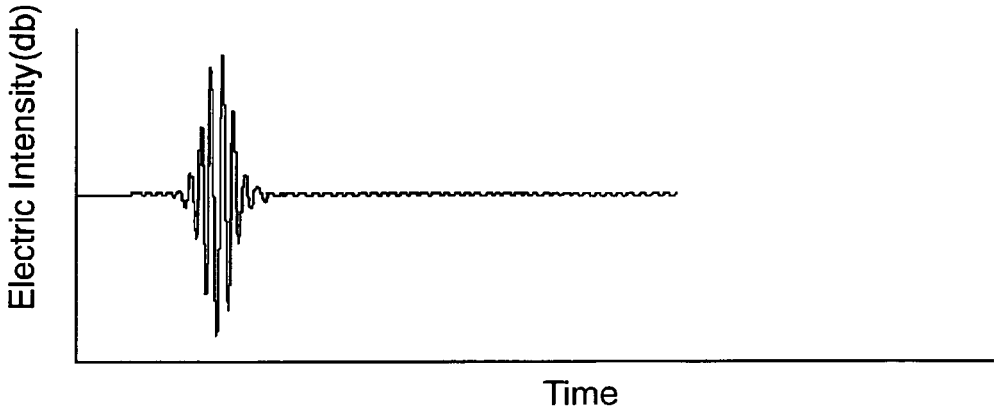
FIG. 27 Time sequential change of receiving electric intensity in a conventional monopole antenna installed outside of a vehicle.
Figure 28:
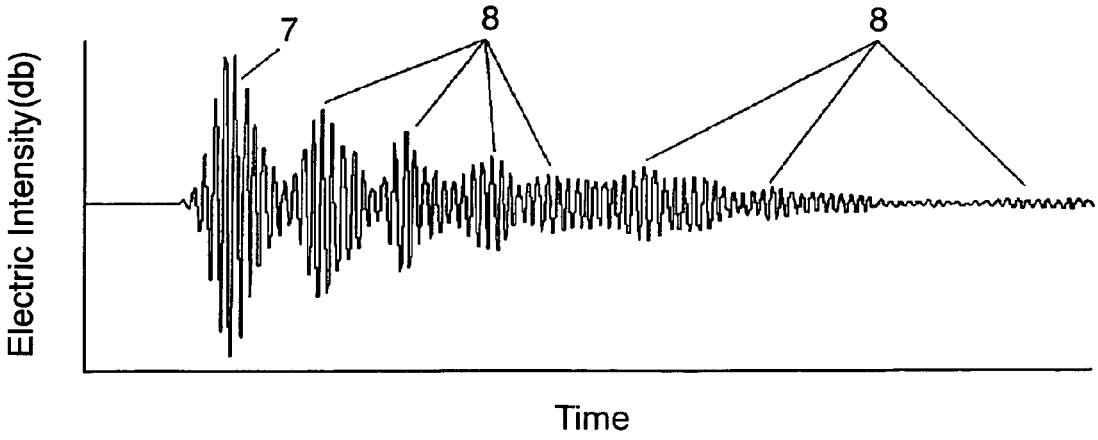
FIG. 28 Time sequential change of receiving electric intensity in a conventional monopole antenna installed in a vehicle cabin.
Figure 29:
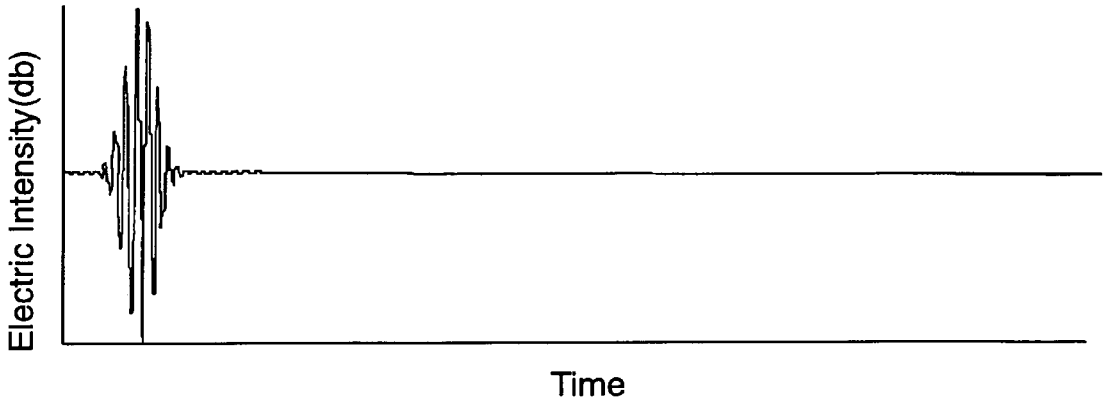
FIG. 29 Time sequential change of electric intensity of a plane wave arriving from outside of a vehicle, a conventional example.

Now, change in the specific band is described using practical examples. FIG. 18 shows relationship between the angle at first acute angle vertex 106, second acute angle vertex 112 and the specific band RBW 181 (L17=0.1 mm), RBW 182 (L17=0.2 mm), RBW 183 (L17=0.2 mm); where, distance L116 between base 116 and power supply section 101 (ref. FIG. 17) is 15 mm, distance L17 between first parallel side 107 and second parallel side 113 is varied to be 0.1 mm, 0.2 mm and 0.3 mm, line length of first parallel side 107 and second parallel side 113 is 25 mm. RBW 23 of conventional dipole antenna (FIG. 23) is also shown in FIG. 18.

When angle θ 106 of first acute angle vertex 106 and angle θ 112 of second acute angle vertex 112 are within a range of approximately 12 degrees to 48 degrees, it exhibited the characteristics that was superior to the specific band with conventional dipole antenna. Within the above angle range, the specific band further expanded when θ 106 and θ 112 are approximately 20 degrees to 40 degrees.

If angles θ 106 and θ 112 at first acute angle vertex 196 and second acute angle vertex 112 are made to be more than 20 degrees, the lengths of first oblique side 109 and second oblique side 115 become to be more different from the lengths of first triangle base 108 and second triangle base 114. As the result, the specific band becomes greater.

On the other hand, if the angles θ 106 and θ 112 are made to be smaller than 40 degrees, first oblique side 109 gets to be closer to a parallel arrangement with first triangle base 108, second oblique side 115 to be closer to a parallel arrangement with second triangle base 114. When the vector of reception current i 109 in first oblique side 109 and that of reception current i 115 in second oblique side 115 are decomposed, respectively, into parallel component and vertical component with respect to first triangle base 108 and second triangle base 114, the vertical component of current vector becomes smaller as the result of the above-described reduced angles θ 106 and θ 112. Direction of the vertical component of current i 109 in first oblique side 109 and that of the vertical component of current vector i 115 in second oblique side 115 is opposite to each other; so, they set off to each other. Therefore, it is desirable that the currents have smaller vertical components. In this way, first oblique side 109 and second oblique side 115 will exhibit improved radiation characteristics, and the specific band broadened.

The specific band is maximized by making angle θ 106 at first acute angle vertex 106 and angle θ 112 at second acute angle vertex 112 to be approximately 30 degrees.

Sixth Exemplary Embodiment

Figure 19:
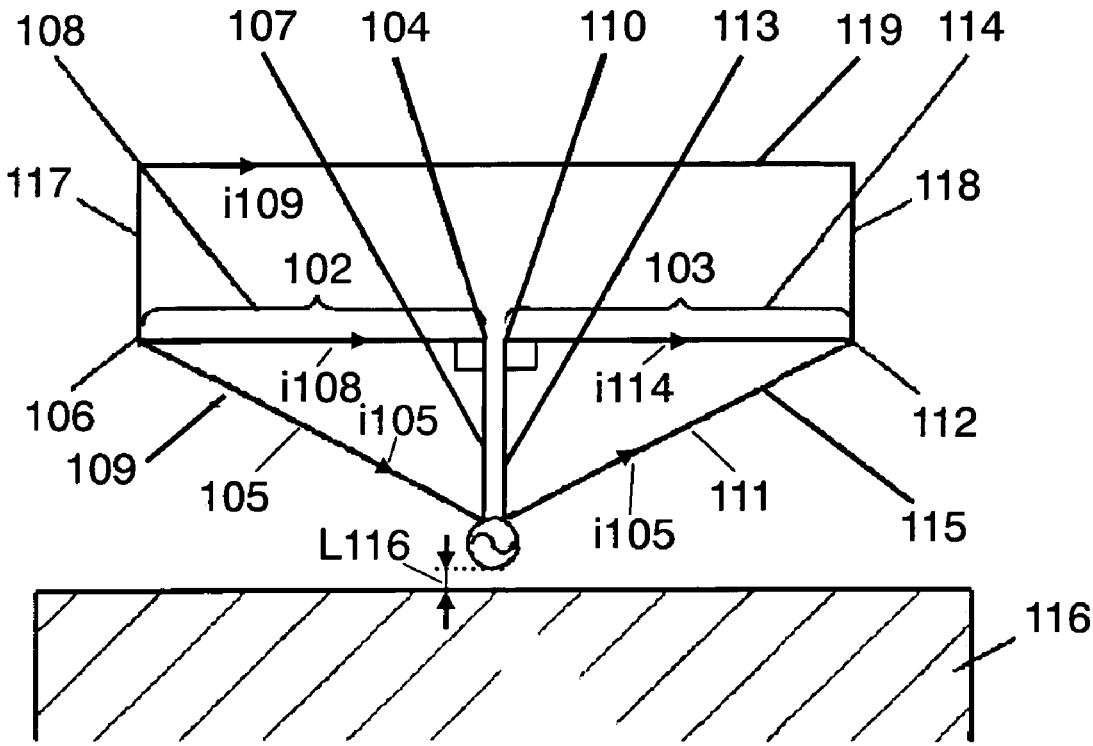
FIG. 19 Structure of an antenna system in accordance with a sixth exemplary embodiment of the present invention.

FIG. 19 shows the structure of an on-vehicle antenna system in accordance with the sixth embodiment. Basic structure of the sixth embodiment remains substantially the same as that of the fifth embodiment. The point of difference as compared with the fifth embodiment is that the sixth embodiment further includes first parallel line 117 which is connected at one end with first acute angle vertex 106 and approximately parallel with first parallel side 107, and second parallel line 118 which is connected at one end with second acute angle vertex 112 and approximately parallel with second parallel side 113. The other end of first parallel line 117 and the other end of second parallel line 118 are connected by perpendicular line 119, which is substantially perpendicular to first parallel line 117 and second parallel line 118.

Now, signal receiving operation of an antenna system in the sixth embodiment is described referring to FIG. 19.

The receiving currents flowing in first conductor 102 and second conductor 103 remain the same as in the fifth embodiment. Reception current i 119 which contributes to the receiving on perpendicular line 119 flows, as illustrated in FIG. 19, in the same direction as reception currents i 108 and i 114 flowing in first and second triangle bases 108, 114. This is an application of the operating principle of folded dipole antenna. The folded dipole antenna is an antenna system having two or more number of dipole antennas disposed parallel to each other, connected together at their ends, one of the dipoles is supplied with power at the center. In this configuration, two dipole antennas of half-wavelength disposed in parallel have identical currents of the same phase.

The above-structured antenna has the combined appearance of a broad band triangular dipole antenna and a dipole antenna. The antenna system exhibits an improved radiation characteristic, and expands the specific band a step further.

Seventh Exemplary Embodiment

Figure 20:
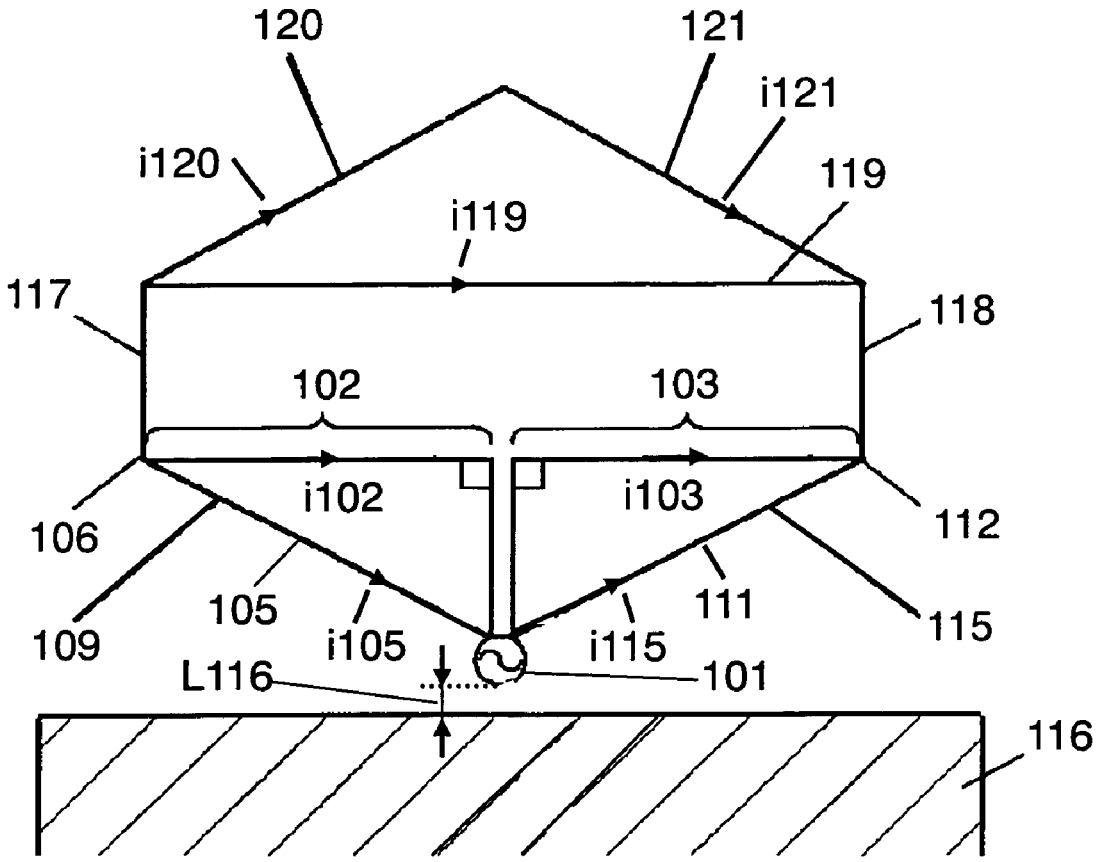
FIG. 20 Structure of an antenna system in accordance with a seventh exemplary embodiment of the present invention.
Figure 21:
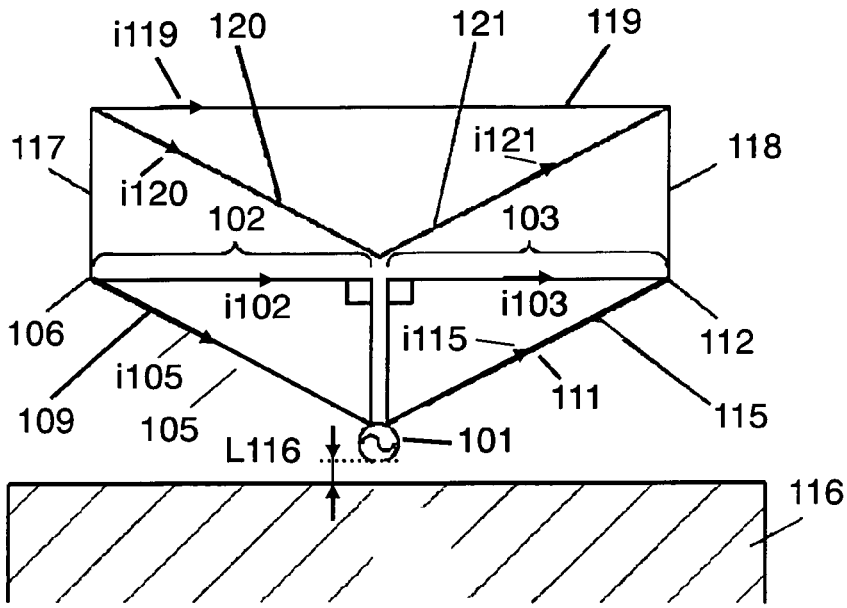
FIG. 21 Structure of an antenna system in the seventh embodiment.

An antenna system in accordance with seventh embodiment is described referring to FIG. 20 and FIG. 21. Basic structure of the antenna system in the seventh embodiment remains substantially the same as that of the fifth embodiment and the sixth embodiment.

The point of difference as compared with the sixth embodiment is that it is further provided with third oblique side 120 connected with the connection point of first parallel line 117 and perpendicular line 119, and fourth oblique side 121 connected with the connection point of second parallel line 118 and perpendicular line 119. Thus, an approximate isosceles triangle is formed with perpendicular line 119, third oblique side 120 and fourth oblique side 121.

The signal receiving operation of an antenna system in the seventh embodiment is described referring to FIG. 20 and FIG. 21.

Reception currents i 102, i 103 and i 119 in first conductor 102, second conductor 103 and perpendicular line 119, respectively, flow in the same manner as in the fifth and sixth embodiments. Reception current i 120 in third oblique side 120 flows from the connection point of first parallel line 117 and perpendicular line 119 towards the connection point of third oblique side 120 and fourth oblique side 121. Reception current i 121 in fourth oblique line 121 flows from the connection point of third oblique side 120 and fourth oblique side 121 towards the connection point of second parallel line 118 and perpendicular line 119.

In an antenna system of the above-described structure, which is further provided with third oblique side 120 and fourth oblique side 121, the specific band can be broadened a step further.

INDUSTRIAL APPLICABILITY

An on-vehicle antenna system in accordance with the present invention brings about a significantly improved receiving characteristic with the antenna installed at a vehicle's window glass. The antenna system can be mounted on various kinds of electronic apparatus; for example, as the antenna for on-vehicle TV receivers, radio receivers, portable telephone systems, etc., among other kinds of electronic apparatus. Thus, possible field of application seems to be substantial for the antenna system in the present invention.

The invention claimed is:

1. An on-vehicle antenna system comprising a vehicle, an antenna for receiving digital signals installed at upper area of the vehicle's glass pane portion, and a propagation path for propagating the digital signals; wherein the propagation path undergoes an equalization processing at demodulation of the digital signals, and direction of the antenna's smallest radiation pattern and the greatest radiation pattern is directed, respectively, towards behind of the vehicle and ahead of the vehicle.

2. The on-vehicle antenna system of claim 1, the antenna wherein is performing a balanced operation.

3. The on-vehicle antenna system of claim 1, the antenna wherein is formed of dipole antenna.

4. The on-vehicle antenna system of claim 1, the antenna wherein is disposed at an antenna installation distance from the edge of metal roof board of the vehicle which is greater than 0 not greater than 0.325 wavelength.

5. The on-vehicle antenna system of claim 1, the antenna wherein is formed of Yagi antenna.

6. The on-vehicle antenna system of claim 5, the Yagi antenna wherein is formed of a plurality of antenna elements of ¼ wavelength disposed perpendicular to the pillar which is making contact with the front windshield glass.

7. The on-vehicle antenna system of claim 1, the antenna wherein is formed of logarithmic period dipole antenna.

8. The on-vehicle antenna system of claim 1, the antenna wherein is an array antenna formed of two or more number of dipole antennas disposed in parallel.

9. The on-vehicle antenna system of claim 8, the array antenna wherein is formed of a plurality of ¼ wavelength antenna elements disposed perpendicular to the pillar which is making contact with the front windshield glass.

10. The on-vehicle antenna system of claim 1, the antenna wherein is formed of microstrip antenna, reverse F antenna or reverse L antenna.

11. The on-vehicle antenna system of claim 1 comprising a transparent insulating film and an antenna conductor disposed on the film, affixed at the vehicle's glass pane portion.

12. The on-vehicle antenna system of claim 11, the antenna conductor wherein is formed by means of a printing process.

13. The on-vehicle antenna system of claim 11, the film wherein is affixed to the glass pane surface from the inside of cabin.

14. The on-vehicle antenna system of claim 1, the antenna conductor wherein is provided drawn on the vehicle's glass pane.

15. The on-vehicle antenna system of claim 1, disposed within 30 mm from the boundary of metal edge of vehicle's roof board and glass pane, either on the surface or in the glass pane.

16. The on-vehicle antenna system of claim 1, wherein the average width value of antenna element locating within 30 mm from the boundary of metal edge of vehicle's roof board and front windshield glass, either on the surface or in the glass pane, is greater than the average width value of that locating away from the boundary of metal edge of vehicle's roof board and front windshield glass, either on the surface or in the glass pane, for more than 30 mm.

17. The on-vehicle antenna system of claim 1, the antenna wherein is formed of ¼ wavelength monopole antenna disposed perpendicular to the pillar which is making contact with the glass pane.

18. The antenna system of claim 1, further comprising a power supply portion, a first conductor element of a right-angled triangle link connected with the power supply portion, and a second conductor element which is line-symmetrical to the first conductor element with respect to a straight line which contains the power supply portion; wherein the first conductor element having a first right-angled vertex, a first power supply vertex connected with the power supply portion, and a first acute angle vertex other than those first right-angled vertex and first power supply vertex;

the second conductor element having a second right-angled vertex, a second power supply vertex connected with the power supply portion, and a second acute angle vertex other than those second right-angled vertex and second power supply vertex; and a first parallel side of the first conductor element containing the first right-angled vertex and the first power supply vertex and a second parallel side of the second conductor element containing the second right-angled vertex and the second power supply vertex are parallel to each other.

19. The antenna system of claim 18, the angle wherein at the first acute angle vertex and at the second acute angle vertex is within a range between 12 degrees to 48 degrees.

20. The antenna system of claim 19, the angle wherein at the first acute angle vertex and at the second acute angle vertex is within a range between 20 degrees to 40 degrees.

21. The antenna system of claim 20, the angle wherein at the first acute angle vertex and at the second acute angle vertex is 30 degrees.

22. The antenna system of claim 18, further comprising a first parallel line which is connected at one end with the first acute angle vertex and parallel to the first parallel side, a second parallel line which is connected at one end with the second acute angle vertex and parallel to the second parallel side, and a perpendicular line which connects the other end of the first parallel line and the other end of the second parallel line and existing perpendicular to the first parallel side and the second parallel side.

23. The antenna system of claim 22, further comprising a third oblique side which is connected with the connection point of the first parallel line and the perpendicular line, and a fourth oblique side which is connected with the connection point of the second parallel line and the perpendicular line, wherein the perpendicular line, the third oblique side and the fourth oblique side forms an isosceles triangle employing the third oblique side and the fourth oblique side as the triangle's oblique sides.

24. An on-vehicle antenna system comprising a vehicle, an antenna for receiving digital signals installed at upper area of the vehicle's glass pane portion, and a propagation path for propagating the digital signals; wherein the propagation path undergoes an equalization processing at demodulation of the digital signals, and direction of the antenna's smallest radiation pattern and the greatest radiation pattern is directed, respectively, towards inside of the vehicle's cabin and outside of the cabin.

25. The on-vehicle antenna system of claim 24, the glass pane portion wherein is the vehicle's side glass.

26. The on-vehicle antenna system of claim 24, the antenna wherein is performing a balanced operation.

27. The on-vehicle antenna system of claim 24, the antenna wherein is formed of dipole antenna.

28. The on-vehicle antenna system of claim 24, the antenna wherein is disposed at an antenna installation distance from the edge of metal roof board of the vehicle which is greater than 0 not greater than 0.325 wavelength.

29. The on-vehicle antenna system of claim 24, the antenna wherein is formed of Yagi antenna.

30. The on-vehicle antenna system of claim 29, the Yagi antenna wherein is formed of a plurality of antenna elements of ¼ wavelength disposed perpendicular to the pillar which is making contact with the front windshield glass.

31. The on-vehicle antenna system of claim 24, the antenna wherein is formed of logarithmic period dipole antenna.

32. The on-vehicle antenna system of claim 24, the antenna wherein is an array antenna formed of two or more number of dipole antennas disposed in parallel.

33. The on-vehicle antenna system of claim 32, the array antenna wherein is formed of a plurality of ¼ wavelength antenna elements disposed perpendicular to the pillar which is making contact with the front windshield glass.

34. The on-vehicle antenna system of claim 24, the antenna wherein is formed of microstrip antenna, reverse F antenna or reverse L antenna.

35. The on-vehicle antenna system of claim 24 comprising a transparent insulating film and an antenna conductor disposed on the film, affixed at the vehicle's glass pane portion.

36. The on-vehicle antenna system of claim 35, the antenna conductor wherein is formed by means of a printing process.

37. The on-vehicle antenna system of claim 35, the film wherein is affixed to the glass pane surface from the inside of cabin.

38. The on-vehicle antenna system of claim 24, the antenna conductor wherein is provided drawn on the vehicle's glass pane.

39. The on-vehicle antenna system of claim 24, disposed within 30 mm from the boundary of metal edge of vehicle's roof board and glass pane, either on the surface or in the glass pane.

40. The on-vehicle antenna system of claim 24, wherein the average width value of antenna element locating within 30 mm from the boundary of metal edge of vehicle's roof board and front windshield glass, either on the surface or in the glass pane, is greater than the average width value of that locating away from the boundary of metal edge of vehicle's roof board and front windshield glass, either on the surface or in the glass pane, for more than 30 mm.

41. The on-vehicle antenna system of claim 24, the antenna wherein is formed of ¼ wavelength monopole antenna disposed perpendicular to the pillar which is making contact with the glass pane.

42. An on-vehicle antenna system comprising a diversity antenna, which diversity antenna being formed with at least either one of a first on-vehicle antenna system disposed at the vehicle's glass pane portion with direction of the smallest radiation pattern directed towards behind of the vehicle and a second on-vehicle antenna system disposed at the vehicle's glass pane portion with direction of the smallest radiation pattern directed towards inside of the vehicle cabin with respect to the glass pane.

43. An on-vehicle antenna system comprising a diversity antenna, which diversity antenna being formed of a first on-vehicle antenna having a radiation pattern with direction of the greatest radiation pattern directed towards ahead or behind of the vehicle while the smallest radiation pattern towards inside of the vehicle's cabin, and a second on-vehicle antenna having a radiation pattern with direction of the greatest radiation pattern directed perpendicular to the vehicle's front—rear direction, or across both sides of the vehicle, while the smallest radiation pattern along the vehicle's front—rear direction.

44. The on-vehicle antenna system of claim 43 comprising a diversity antenna, which diversity antenna being formed of a first on-vehicle antenna system disposed at the vehicle's front windshield glass with direction of the greatest radiation pattern directed towards ahead of the vehicle while the smallest radiation pattern towards behind of the vehicle, and a monopole antenna disposed at the upper area of the vehicle's front windshield glass or the upper area of the vehicle's rear windshield glass with the power supply portion at the vehicle's roof board side.

45. The on-vehicle antenna system of claim 43 comprising a diversity antenna, which diversity antenna being formed of a first on-vehicle antenna system disposed at the vehicle's front windshield glass with direction of the greatest radiation pattern directed towards ahead of the vehicle while the smallest radiation pattern towards behind of the vehicle, and a dipole antenna disposed perpendicular to the border of vehicle's roof board and front windshield glass or rear glass.

46. The on-vehicle antenna system of claim 43 comprising a diversity antenna, which diversity antenna being formed of a patch antenna disposed at the vehicle's rear glass with direction of the greatest radiation pattern directed towards outside of the vehicle cabin with respect to the glass pane while the smallest radiation pattern towards inside of the vehicle cabin with respect to the glass pane, and a monopole antenna disposed at the upper area of the vehicle's front windshield glass or the upper area of rear glass with the power supply portion at the vehicle's roof board side.

47. The on-vehicle antenna system of claim 43 comprising a diversity antenna, which diversity antenna being formed of a patch antenna disposed at the vehicle's rear glass with direction of the greatest radiation pattern directed towards outside of the cabin with respect to the glass pane while the smallest radiation pattern towards inside of the cabin with respect to the glass pane, and a dipole antenna disposed perpendicular to the border of vehicle's roof board and front windshield glass or rear glass.

48. An electronic apparatus comprising at least either one of a first on-vehicle antenna system installed at glass pane portion of a vehicle with direction of the smallest radiation pattern directed towards behind of the vehicle and a second on-vehicle antenna system installed at the vehicle's glass pane portion with direction of the smallest radiation pattern directed towards inside of the vehicle cabin with respect to the glass pane.

49. A television receiver comprising the electronic apparatus of claim 48.

50. A radio receiver comprising the electronic apparatus of claim 48.

51. A transmitting/receiving unit of a portable telephone system, comprising the electronic apparatus of claim 48.

* * * * *